US006533217B2

(12) United States Patent
Lind

(10) Patent No.: US 6,533,217 B2
(45) Date of Patent: Mar. 18, 2003

(54) WEB-PROCESSING APPARATUS

(75) Inventor: Matthew R. Lind, Hartford, WI (US)

(73) Assignee: Faustel, Inc., Germantown, WI (US)

( * ) Notice: Subject to any disclaimer, the term of this patent is extended or adjusted under 35 U.S.C. 154(b) by 0 days.

(21) Appl. No.: 09/812,929

(22) Filed: Mar. 20, 2001

(65) Prior Publication Data

US 2002/0134882 A1 Sep. 26, 2002

(51) Int. Cl.[7] ..... B65H 23/24; F26B 13/06

(52) U.S. Cl. ..... 242/615.12; 226/97.1; 34/642; 242/615.2

(58) Field of Search ..... 226/95, 97.1; 242/615.12, 242/615.2, 615.4; 34/642

(56) References Cited

U.S. PATENT DOCUMENTS

| | | | | |
|---|---|---|---|---|
| 2,736,106 A | * | 2/1956 | Offen | 242/615.12 |
| 3,142,428 A | * | 7/1964 | Faeber | 226/95 |
| 3,189,240 A | * | 6/1965 | Emslie | 242/615.12 |
| 3,270,932 A | * | 9/1966 | Smith, Jr. | 226/95 |
| 3,448,907 A | | 6/1969 | Otepka et al. | |
| 3,567,093 A | * | 3/1971 | Johnson | 242/615.12 |
| 3,701,135 A | * | 10/1972 | Price | 242/615.12 |
| 3,763,571 A | | 10/1973 | Vits | |
| 3,964,656 A | | 6/1976 | Hella | |
| 4,124,156 A | * | 11/1978 | Waffner | 242/615.12 |
| 4,218,833 A | | 8/1980 | Coar | |
| 4,242,807 A | | 1/1981 | Braun | |
| 4,265,384 A | | 5/1981 | Daane | |
| 4,425,719 A | | 1/1984 | Klein et al. | |
| 4,639,927 A | | 1/1987 | Uno et al. | |
| 4,718,178 A | | 1/1988 | Whipple | |
| 4,767,042 A | | 8/1988 | Daane | |

(List continued on next page.)

FOREIGN PATENT DOCUMENTS

JP 59-74850 A1 * 4/1984

OTHER PUBLICATIONS

Caratsch AG, brochure titled, "Takuma Curring Ovens: Heating by Far Infrared Radiation" ( 7 pages). Please note pp. 2 and 7. Date: prior to Mar. 20, 2000.

Caratsch AG, brochure titled,"Impregnating Machings for Prepregs" ( 5 pages). Please note the entire document. Date: prior to Mar. 20, 2000.

C.A. Litzler Co., Inc., excerpts from Litzler website www-.calitzer.com (2 pages). Please note p. 2. Date: undated.

C.A. Litzler Co., Inc., excerpts from brochure titled "In Process" (3 pages). Please note p. 3. Date: 1999, vol. 7, issue 1, Spring/Summer 1999.

MEGTEC Systems, excerpts from Megtec website www-.megtec.com (11 pages). Please note pp. 7–11. Date: Copyright notice at p. 4 indicates publication date of 1998.

*Primary Examiner*—Michael R. Mansen
(74) *Attorney, Agent, or Firm*—Jansson, Shupe & Munger, Ltd.

(57) ABSTRACT

A web-processing apparatus comprises a dryer with air-turn apparatus for flotatingly supporting a web and, preferably, for changing a direction of web movement. The air-turn apparatus may be used in the web dryer or with other suitable web-processing equipment, particularly in applications where a coated web side faces the air-turn apparatus. Preferred forms of the air-turn apparatus comprise a body having an outer surface defining a web flotation zone facing a coated side of the web and a plurality of openings in the body positioned along the web flotation zone. An air-conducting conduit provides pressurized air to the body and body openings thereby forming an air cushion at the web flotation zone on which the coated web is flotatingly supported without contacting the body.

22 Claims, 11 Drawing Sheets

U.S. PATENT DOCUMENTS

| | | | | | |
|---|---|---|---|---|---|
| 4,768,695 | A | | 9/1988 | Stibbe | |
| 4,777,736 | A | | 10/1988 | VanOursouw et al. | |
| 4,779,355 | A | | 10/1988 | Petros | |
| 4,779,358 | A | | 10/1988 | Atkinson et al. | |
| 4,785,986 | A | | 11/1988 | Daane et al. | |
| 4,787,547 | A | | 11/1988 | Hella et al. | |
| 4,833,794 | A | | 5/1989 | Stibbe et al. | |
| 4,837,946 | A | | 6/1989 | Hella et al. | |
| 4,922,628 | A | | 5/1990 | Hella | |
| 4,925,077 | A | | 5/1990 | Daane et al. | |
| 4,938,404 | A | | 7/1990 | Helms et al. | |
| 4,944,098 | A | | 7/1990 | Hella et al. | |
| 5,070,628 | A | | 12/1991 | Zagar | |
| 5,104,489 | A | * | 4/1992 | Beisswanger et al. | 226/95 |
| 5,105,562 | A | | 4/1992 | Hella et al. | |
| 5,112,486 | A | | 5/1992 | Fujiwara et al. | |
| 5,121,560 | A | | 6/1992 | Daane et al. | |
| 5,134,788 | A | | 8/1992 | Stibbe et al. | |
| 5,232,141 | A | * | 8/1993 | Mittmeyer et al. | 226/95 |
| 5,242,095 | A | | 9/1993 | Creapo et al. | |
| 5,263,265 | A | | 11/1993 | Melgaard | |
| 5,370,289 | A | | 12/1994 | Helms | |
| 5,571,563 | A | | 11/1996 | Helms et al. | |
| 5,571,564 | A | | 11/1996 | Helms et al. | |
| 5,676,754 | A | | 10/1997 | Helms et al. | |
| 5,749,164 | A | | 5/1998 | Bowden | |
| 5,857,270 | A | | 1/1999 | Bria | |
| 5,867,920 | A | | 2/1999 | Rogne et al. | |
| 6,027,337 | A | | 2/2000 | Rogers et al. | |
| 6,067,726 | A | | 5/2000 | Rogne et al. | |
| 6,195,909 | B1 | | 3/2001 | Rogne et al. | |
| 6,336,608 | B1 | * | 1/2002 | Cope | 226/97.1 |

OTHER PUBLICATIONS

Advance Systems, Inc., excerpts from Advance Systems website www.advancesystems.com (3 pages). Date: Copyright notice at p. 1 indicates publication date of 1996–1999.

Advance Systems, Inc., brochure titled, ". . . Where New Technology is in the Air" (12 pages). Please note pp. 4–8. Date: prior to Mar. 20, 2000.

Dec–E–Tech, excerpts from Dec–E–Tech website www.decetech.com (5 pages). Date: p. 1 indicates date of Aug. 8, 2000.

Spooner Industries, Ltd., excerpts from Spooner website www.spooner.co.uk (7 pages). Please note pp. 5–7. Date: undated.

Xeric Web Drying Systems, excerpts from Exeric website www.xericweb.com (3 pages). Please note pp. 1 and 3. Date: undated.

Faustel, Inc., two photographs showing stationary air turn apparatus. Date: Prior to 1995.

* cited by examiner

FIG. 6A
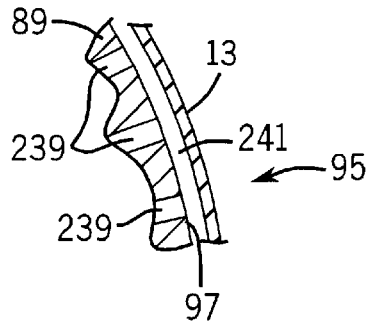
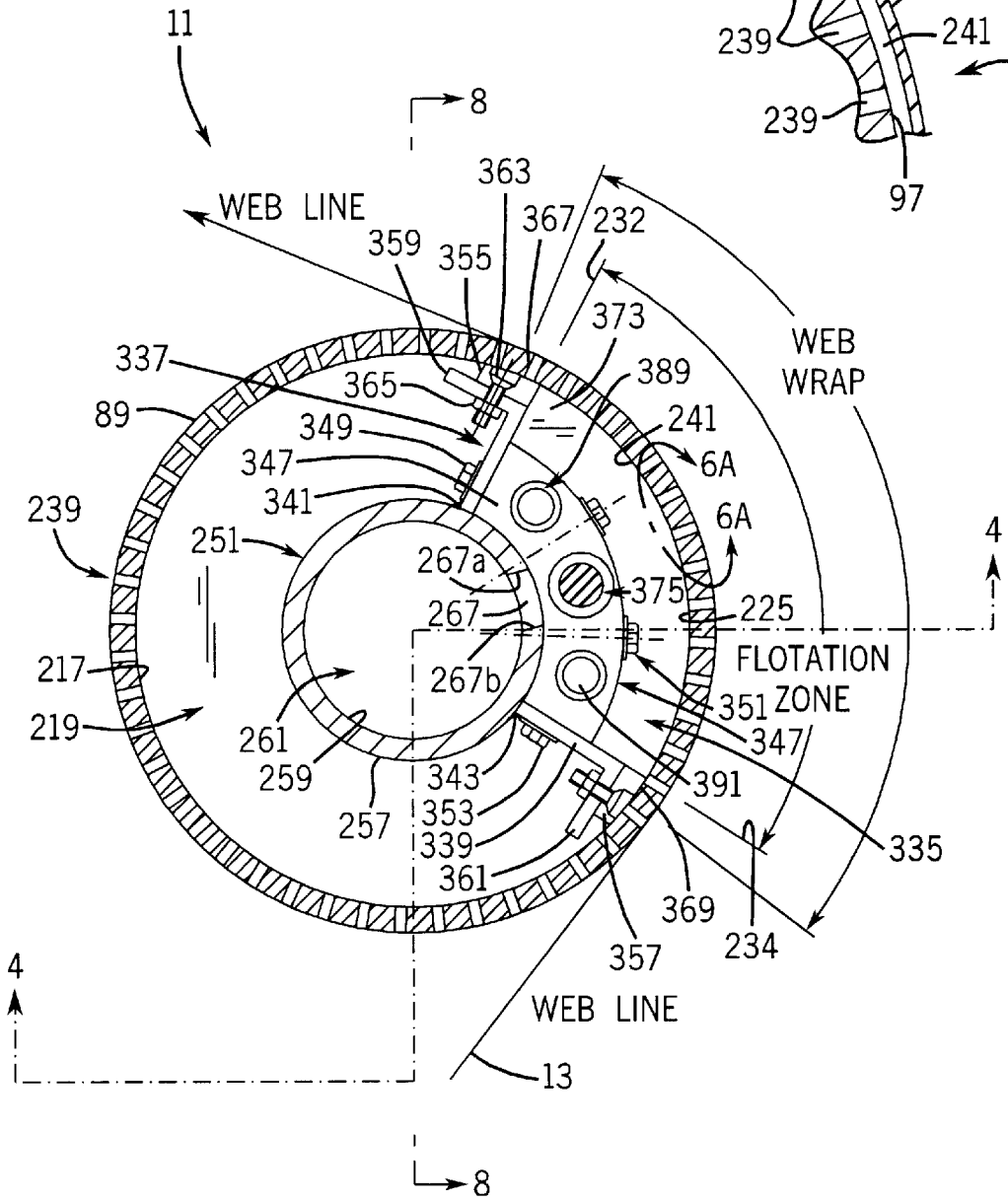
FIG. 6

WEB-PROCESSING APPARATUS

FIELD OF THE INVENTION

The invention is related generally to web-processing apparatus and, more particularly, to apparatus for processing a coated web and air-turn apparatus used to support the web during processing.

BACKGROUND OF THE INVENTION

In many manufacturing or processing operations material, in the form of a material web, is coated or treated with various inks, resins and other substances in order to impart desired properties to the material. Web materials processed in this manner include, for example, glass fiber, paper, film and metals. The coating process typically involves unwinding the material from a supply roll, applying the coating, drying the coated web and re-winding the coated web onto a take-up roll or otherwise processing the coated web. The coating is typically a liquid and is applied to one or both sides of the web or by impregnating the web by, for example, immersing the web in a bath or spraying the coating on the web.

An important limitation with respect to the amount of web material that can be processed during a given unit time is the rate at which the web material can be dried following coating. It is important to dry the web rapidly because wet coating can be damaged or removed by contact with rollers and other coating apparatus components. Moreover, the web material often cannot be re-wound or processed further until the web coating has dried to a predetermined extent.

Web dryers are commonly used to process the coated web. The dryer increases the rate at which the coating is dried thereby increasing the rate at which the web can be processed. Typically, the web dryer is positioned along the path of the moving web downstream of the coating apparatus and may include air jets or heat sources to dry the web coating. In coating operations known as "pre-preg" coating operations, the web is moved through the dryer following coating at rates ranging from about 40–80 feet/minute to as high as 100 feet/minute. In other coating and processing operations the web speed may be much greater. The path of the web through the dryer can be as long as required to adequately dry the coating.

While web dryers are highly effective at increasing the rate at which the coating dries, they are not without certain disadvantages. One potential disadvantage is that dryers have a large footprint and occupy a significant amount of floor space at the operator's facility. One solution to this dryer-size-related problem is to provide plural parallel drying sections (rather than a single linear dryer section) and direction-changing apparatus to direct the web through the parallel dryer sections. Such an arrangement can reduce the amount of space required for the dryer.

In vertical dryers, cylindrically shaped, chilled rollers are used to change the direction of web movement. Chill rollers are well known and are commercially available, for example, from the F.R. Gross Company of Stow, Ohio. After initial drying in a first vertically-oriented drying section the web is then directed over, for example, paired chill rollers, through a 180° direction change, and through a second vertically-oriented drying section to complete the drying process. In such an operation, the web comes into direct physical contact with the chill rollers as the direction of web movement changes.

However, the use of such direction-changing chill rollers may be less than satisfactory in certain coating operations, particularly where the web is impregnated with coating material or where it is desired to apply coating to the web side facing the roller. Any such contact should be avoided because such contact can potentially damage any not-yet-dried coating material on the web. For example, the coating could, in certain circumstances, become adhered to the roller or the coating could be scraped away from the web by contact with the roller surface. Cooling of the chill roller minimizes potential adherence of coating to the roller. However, this is not a complete solution because any contact between the roller and coating creates the possibility that the coating will attach to the roller or otherwise become damaged.

In a further effort to minimize this contact-related problem, manufacturers of dryer apparatus have been required to provide refrigeration apparatus to cool the web and the web coating before the web contacts the chill roller. The refrigeration apparatus is provided in the form of a separate cooling zone or chamber adjacent the first chill roller. Refrigeration apparatus is provided to reduce the temperature in the cooling zone thereby cooling the web and web coating. Cooling of the web in this manner has been found to reduce, but not completely eliminate, adherence of coating material to the roller. As mentioned, the cooled web may be re-heated after passing over the chill rollers in order to complete the drying process.

Use of such refrigeration or chilling apparatus includes certain potential disadvantages. One potential disadvantage is that the cooling process is energy intensive both with respect to the energy required to cool the web but also with respect to the additional energy needed to reheat the cooled web in the downstream dryer sections. Another disadvantage is that alternate heating and cooling of the web reduces the rate at which the web can be processed through the dryer thereby reducing dryer efficiency. A further potential disadvantage of the cooling process is the additional cost of the refrigeration and related equipment used to cool the web.

Yet another possible disadvantage of the cooling process stems from the increased maintenance costs required to avoid potential contamination of the web as the web passes through the cooling section or sections. Contamination of the web could potentially occur as evaporating solvents and other materials (such as dirt or airborne particulates) condense and/or collect on the cool surface areas of the dryer within the cooling section. These materials can flake off and collect on the web and web coating possibly contaminating the web. Any such contamination should be avoided.

Removal and cleaning of the potential contaminates from the cooling section is a labor-intensive project which must be performed on a frequent basis increasing the cost of the coating operation. Further increasing the cost of operation is the fact that the processing line must typically be shut down for the cleaning to take place. This results in disruption of the manufacturing process.

The foregoing problems involving potential undesired contact between a support and/or direction-changing roller and a coated web surface facing the roller are present in other types of web-processing operations. For instance, in web laminating operations it is often necessary to change the direction of web movement in order to process the web, for example by steam moisturizing of the web before passage of the web into a laminator apparatus. However, conventional chill roller apparatus have proven unsatisfactory for this purpose because it is possible to change the web direction only about 180° without contacting the coated side of the web. As a result, less-than optimal processing line configurations have been developed simply because of the inability to change web direction without contact between the roller and the coated surface of the web.

Improved web-processing apparatus which would facilitate an improvement in the quality of products manufactured in coating operations, which would facilitate the use of more compact and efficient dryers and processing equipment used in coating operations and which would generally make processing operations more efficient would represent an important advance in the art.

OBJECTS OF THE INVENTION

It is an object of this invention to provide improved web-processing apparatus overcoming some of the problems and shortcomings of the prior art.

An important object of this invention is to provide improved web-processing apparatus which includes apparatus for changing the direction of web movement yet does not require a cooling section upstream of the web direction-changing apparatus.

It is also an object of the invention to provide improved web-processing apparatus capable of making coating operations more efficient.

A further object of the invention is to provide improved web-processing apparatus which facilitate improvement in the quality of product produced in coating operations.

Yet another object of the invention is to provide improved web-processing apparatus which reduces energy consumption.

Another object is to provide improved web-processing apparatus which facilitates an increase in the rate at which web material can be dried.

Still another object of the invention is to provide improved web-processing apparatus which facilitates processing of the web with reduced potential for possible web contamination.

Yet another object of this invention is to provide improved web-processing apparatus which permits a change in the direction of web movement yet minimizes actual contact between the web and the processing apparatus.

An object of this invention is to provide improved web-processing apparatus capable of processing webs of different widths.

A further object of the invention to provide improved web-processing apparatus with an efficient design.

One additional object of the invention is to provide improved web-processing apparatus which facilitates changes in the direction of web travel.

How these and other objects are accomplished will be apparent from the following descriptions and from the drawings.

SUMMARY OF THE INVENTION

The invention comprises web-processing apparatus for processing a coated web and air-turn apparatus used to support the web during processing. The novel air-turn apparatus facilitates construction of dryers without separate cooling apparatus adjacent the air-turn apparatus and further facilitates optimal process equipment configurations.

In one embodiment, an improved web dryer including the air-turn apparatus is provided for drying a coating-impregnated web or web having a coated side facing the air-turn apparatus. The dryer is provided with a support frame having a web inlet, a web outlet and a web path between the inlet and outlet. Dryer apparatus mounted with respect to the frame, and proximate to the web, dry the coated web moving along the web path. Cooling apparatus may optionally be mounted with respect to the frame and along the web path downstream of the dryer apparatus for cooling the coated web moving along the web path after drying and before rewinding of the web or further web processing.

One or more air-turn apparatus may be mounted along the dryer frame and along the web path for changing the direction of web movement along the web path. The improved air-turn apparatus comprises a body having an outer surface defining an arcuate web flotation zone facing a coated side of the web and a plurality of openings in the body positioned along the web flotation zone.

An air-conducting conduit is preferably positioned at least partially in the body. The conduit has an inlet for receiving pressurized air and at least one outlet in communication with the body openings thereby providing a passageway through which pressurized air may be directed out of the body to form an air cushion at the web flotation zone. An air blower in communication with the conduit inlet supplies pressurized air to the air-turn apparatus. This novel arrangement permits the coated web to be flotatingly supported by the air cushion at the web flotation zone so that the coated side of the web does not directly contact the air-turn apparatus as the web passes the air-turn apparatus. There is no need to pre-chill the web because the web does not contact the air-turn apparatus.

In one preferred embodiment, the body is cylindrically-shaped and has a body axis, first and second end walls, an arcuate outer surface and the web flotation zone is positioned across a predetermined portion of the arcuate outer surface. It is preferred that the body have an inner wall surface defining a body interior. In this preferred embodiment, the body openings are in communication with the body interior.

It is most highly preferred that the body is rotatable and synchronized to rotate with the web so as to minimize any possible frictional contact between the web and the air-turn apparatus. Accordingly, the air-turn apparatus preferably includes a first mount along the body first end wall and a second mount along the body second end wall, the mounts provided for rotatably supporting the body with respect to the frame.

The preferred first mount comprises a stationary centertube and related structure described herein. The centertube is secured with respect to the frame and supports the body for rotation along an axis coaxial with the body axis. In this embodiment the centertube also serves as the conduit for directing air into the body and body openings. The centertube includes a centertube body positioned through an opening in the first end wall and at least partially in the body interior, a centertube outer surface, a centertube inner surface defining a hollow air conduit, an air inlet in communication with the air conduit and at least one air outlet in communication with the body interior. The most highly preferred body first end wall includes a fixed inner wall portion, a rotatable outer wall portion and bearing structure therebetween permitting rotation of the outer wall and air-turn apparatus body with respect to the centertube and fixed inner wall.

The preferred second mount comprises a shaft supporting the body also along the axis coaxial with the body axis. The shaft has a first end secured with respect to the second end wall for co-rotation of the shaft with the body and a second end portion rotatably secured with respect to the frame.

To promote efficient operation of the air-turn apparatus, it is highly preferred that first and second walls are positioned in the body interior to form a plenum between the centertube and body adjacent the web flotation zone. The plenum efficiently directs pressurized air from the centertube to the web flotation zone.

It is also highly preferred that one or more movably-mounted deckles be provided in the plenum for adjusting an axial dimension of the plenum and directing pressurized air to a predetermined portion of the web flotation zone. Apparatus may be provided to move each deckle within the air-turn apparatus body. Adjustment of the plenum permits the air-turn apparatus to be used with webs of different widths.

Preferably, the air-turn apparatus is chilled to prevent any possible sticking of the web coating to the air-turn apparatus in the unintended event that the web and air-turn apparatus should come into contact. Such preferred air-turn apparatus embodiment includes a coolant-conducting conduit in the air-turn apparatus body. The conduit is in heat-transfer communication with the body outer surface and has an inlet for receiving pressurized coolant and an outlet for discharging the coolant. Preferably, the coolant-conducting conduit is positioned between the body inner and outer surfaces and the coolant inlet and outlet comprise separate passageways in the second shaft. Refrigeration apparatus is preferably in fluid communication with the conduit inlet and outlet for supplying chilled coolant to the conduit. Optionally, a low-friction coating may be affixed to the body outer surface to further minimize any adherence of the coating to the air-turn apparatus.

The dryer preferably includes drive apparatus for synchronously rotating the body with the web. The drive apparatus may include a motor, linkage apparatus connecting the motor to the body and control apparatus for controlling the motor.

The air-turn apparatus may be used in various web-processing operations including, without limitation, "pre-preg" coating operations and lamination operations.

It should be noted that use of the terms "air-turn apparatus" or "air" throughout the application reflects the fact that the invention will most likely utilize pressurized air for purposes of creating the "air cushion" used to flotatingly support the web. However, these terms are not intended to be limiting because any suitable pressurized gas may be used to support the web along the novel air-turn apparatus. Indeed, air comprises a mixture of gases such as oxygen, nitrogen and carbon dioxide.

Moreover, the dryer structure and the structure of other components described herein is intended to be illustrative and not limiting. For example, the dryer web outlet and inlet are meant only to refer to locations at which the web enters and exits the dryer. The web could enter and exit the dryer at other locations and the web path could travel both inside and outside of the dryer.

BRIEF DESCRIPTION OF THE DRAWINGS

The drawings illustrate preferred embodiments which include the above-noted characteristics and features of the invention. The invention will be readily understood from the descriptions and drawings. In the drawings:

FIG. 6 is a partial section of an exemplary air-turn apparatus taken along section 6—6 of FIG. 4.

FIG. 6A is an enlarged schematic drawing showing the exemplary web flotation zone along section 6A—6A of FIG. 6.

DETAILED DESCRIPTION OF PREFERRED EMBODIMENTS

Figure 1:
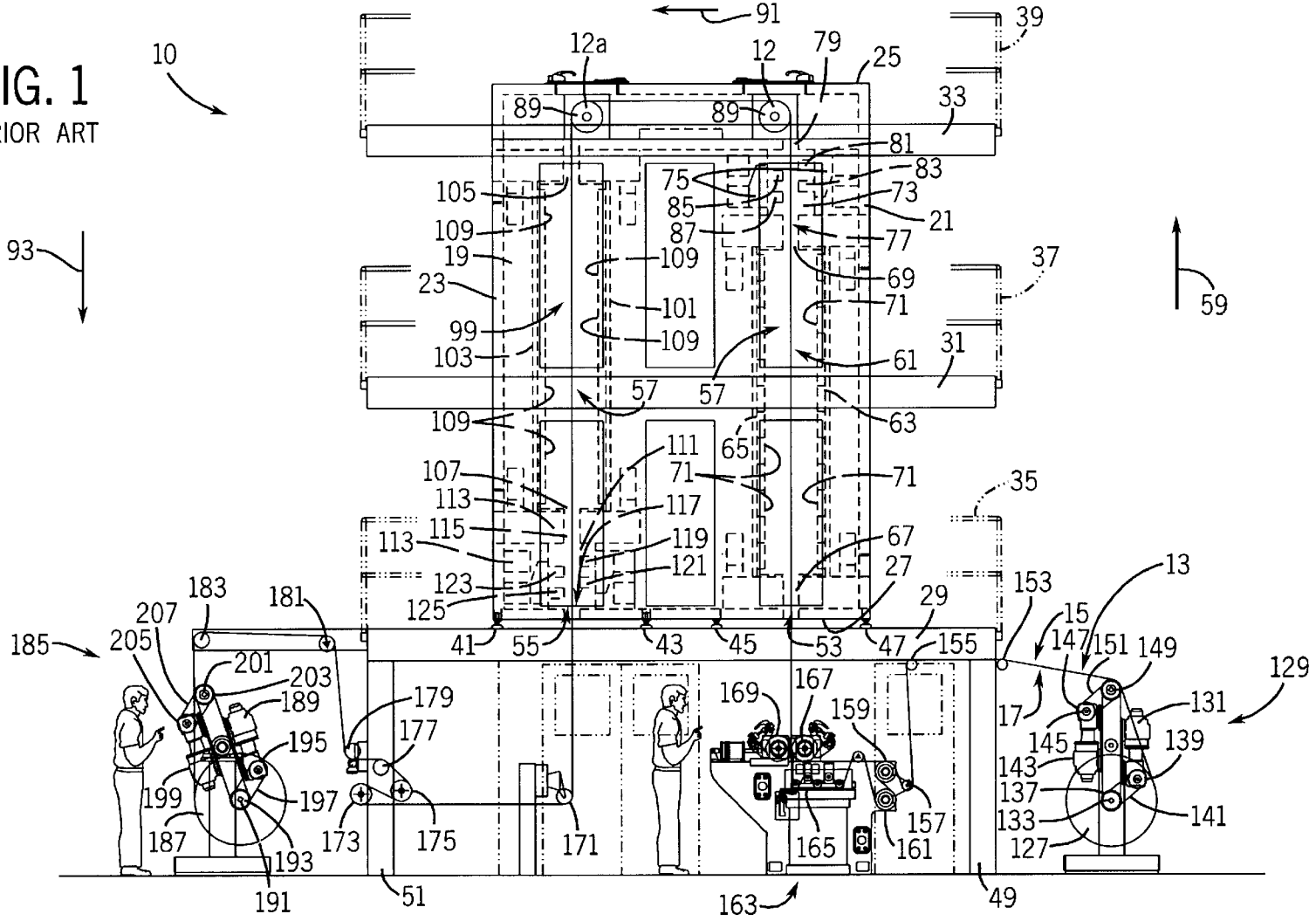
FIG. 1 PRIOR ART
FIG. 1 is a schematic elevation view of an exemplary prior art web dryer apparatus. Certain internal components of the dryer are shown with phantom lines.
Figure 2:
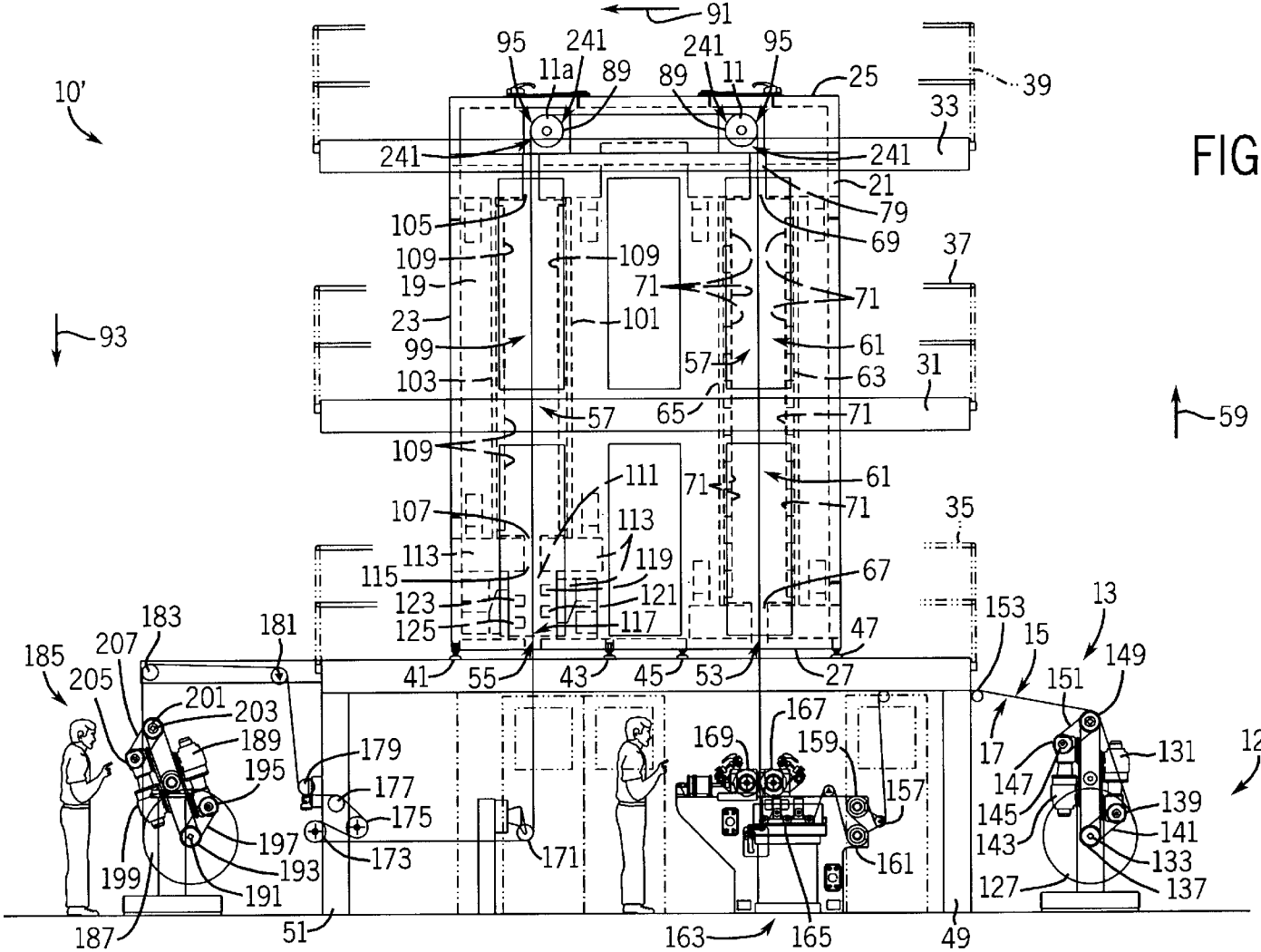
FIG. 2 is a schematic elevation view of an exemplary web dryer apparatus and air-turn apparatus according to the invention. As with FIG. 1, certain internal components of the dryer are shown with phantom lines.

FIG. 1 is a prior art web processing apparatus in the form of exemplary dryer 10. The prior art dryer 10 of FIG. 1 utilizes paired chill rollers to change the direction of web movement within the dryer. A separate chill zone with refrigeration apparatus is provided adjacent to the first chill roller to cool the web and web coating prior to contact between the web and first chill roller. FIG. 2 is an improved dryer 10' according to the invention. In the improved dryer 10', paired air-turn apparatus are provided to change the direction of web movement. The inventive air-turn apparatus permit operation of the dryer without a separate cooling zone upstream from the first air-turn apparatus.

Referring first to FIG. 1, prior art dryer 10 is a vertical dryer of a type useful in "pre-preg" and other coating operations in which the web is impregnated with coating. In a pre-preg coating operation, a material web 13 having first 15 and second 17 side surfaces is impregnated with coating material such that the coating permeates the web and is present on the side surfaces 15, 17. One such pre-preg coating operation involves coating a web 13 of #106 fiberglass cloth with a liquid coating material such as liquid-state epoxy resin and solvent. After curing, the coated fiberglass web 13 will be used in the manufacture of fiberglass-based products including printed circuit boards and the like.

An important consequence of the pre-preg coating process is that coating is present on the web side surface 17 facing the chill roller device or devices 12, 12*a* used to change the direction of web 13 movement. Such an operation requires that steps be taken to prevent coating from sticking to such direction-changing devices.

Referring again to FIG. 1, the exemplary vertical dryer 10 consists generally of a dryer frame 19 provided to support the dryer structure and dryer components. Frame 19 may be of any suitable configuration and material and may include end wall elements 21, 23 and top and bottom walls 25, 27. Frame 19 may also include sidewalls (not shown) to fully or partially enclose dryer 10. Horizontal deck members 29–33 with railings 35–39 (shown cut away in FIG. 1) may optionally be provided to provide technicians with safe access to components of dryer 10.

Dryer 10 is shown supported on deck member 29 by support elements 41–47. Vertical supports 49 and 51 support deck element 29 providing space below dryer 10 for coating apparatus and technicians as described further below.

Referring still to FIG. 1, dryer 10 includes an upstream web inlet 53 through which the web 13 enters dryer 10 and a downstream web outlet 55 through which web 13 exits dryer 10. As shown by the cut away view of dryer 10 indicated by the phantom lines, a web path 57 is provided in dryer 10 along which web 13 travels in a counterclockwise direction shown by arrow 59 (and arrows 91, 93) through dryer 10 from inlet 53 to outlet 55.

Also as shown in the cut away view of FIG. 1, dryer 10 includes several sections or zones provided to facilitate drying of the coated web 13. The first section comprises a first drying or heating zone. Preferably, the first drying zone comprises a chamber 61 within dryer 10 defined by opposed end walls 63 and 65 and opposed sidewalls (not shown). Web 13 enters chamber 61 through chamber inlet 67 and exits chamber 61 through outlet 69. Dryer apparatus, such as infra-red heating panels 71, may be mounted in chamber 61 along respective end walls 63, 65 closely adjacent web path 57 so as to heat and dry coating material on respective web surfaces 15, 17 as web 13 moves through the first drying zone. In this example, the infra-red panels 71 are provided to heat web 13 to a temperature of approximately 400° F. initiating curing and causing resin solvents to partially evaporate.

Any suitable drying or heating apparatus may be provided for purposes of drying web 13 within the chamber 61 of the first drying zone. For example, heated ambient air could be circulated throughout chamber 61 using conventional forced air heating apparatus. Combinations of dryer apparatus may also be suitable for use in certain applications, for example a combination of infra-red or forced air heating. Further, chamber 61 could be of any suitable size and structure required to suit the needs of a particular coating operation.

The next portion of prior art dryer 10 is a required cooling zone positioned downstream of the first drying zone and upstream of the first web-turning apparatus, which is in the form of a chill roller 12. The cooling zone is required to reduce the temperature of the web 13 and web coating to minimize adherence of the coating to the direction-changing chill rollers 12, 12*a*. The cooling zone preferably comprises a cooling chamber 73 within dryer 10. Chamber 73 is defined by cooling apparatus 75 mounted in dryer by suitable means and chamber sidewalls (not shown). Web 13 enters cooling zone chamber 73 through inlet 77 and exits chamber 73 through outlet 79. The temperature of ambient air in chamber 73 is reduced by cooled air directed from cooling apparatus 75 through ducts 81–87 into chamber 73 thereby cooling coated web 13 as it moves through chamber 73 in the direction of arrow 59. The cooling zone is provided to reduce the temperature of ambient air in chamber 73 to a temperature sufficient to reduce the temperature of web 13 (and the coating thereon) to approximately 125° F. before web 13 changes a direction of web movement along chill rollers 12, 12*a*. Any suitable cooling apparatus, such as a forced air refrigeration or a liquid ammonia refrigeration system could be used to cool chamber 73.

Evaporating solvents, dirt and airborne particulates can condense and or collect on cool surface areas within the cooling chamber 73, such as ducts 81–87. These contaminates can flake off the duct surfaces and collect on the web 13 and on the web coating potentially damaging the web 13. Such contamination must be avoided in the manufacture of precision products, such as substrate material used in the manufacture of printed circuit boards.

The ducts 81–87 and other surfaces within cooling chamber 73 must be cleaned regularly to remove contaminates. Such cleaning is labor-intensive and requires that the processing be shut down to permit the cleaning.

The cooling chamber 73 and refrigeration apparatus 75 structure add costs to dryer 10. Dryer 10 energy consumption is increased in order to cycle the web 13 between the approximate 400° F. temperature in chamber 61 and approximate 125° F. temperature produced in chamber 73.

Referring again to FIG. 1, web-turning apparatus, in the form of refrigerated chill rollers 12, 12*a* are provided downstream of chamber 73 to change the direction of web 13, in this example a total of about 180°. The chill rollers 12, 12*a* are shown in side elevation. Each chill roller 12, 12*a* preferably has a cylindrically-shaped body 89 rotatably supported with respect to frame 19. The chill rollers 12, 12*a* directly support web 13 with web 13 in physical contact with each roller body 89 as the direction of web 13 movement is changed first to the direction of arrow 91 and then to the direction of arrow 93. Each chill roller 12, 12*a* is rotatingly driven by a motor, linkage and control apparatus (not shown) to synchronize the rotation of the rollers 12, 12*a* with the movement of the web 13. The combination of the cooling zone, refrigerated chill rollers and release coating on the rollers minimizes adherence of coating on web 13 to rollers 12, 12*a*.

The next dryer section comprises a second drying or heating zone provided along web path 57 downstream of chill roller 12*a*. The second drying zone comprises a chamber 99 within dryer 10 defined by end walls 101 and 103 and sidewalls (not shown). Inlet 105 is provided in chamber 99 for receiving web 13 and web 13 exits chamber 99 through outlet 107. Infra-red heating panels 109, or other suitable heating apparatus (as described with respect to the first drying zone), may be mounted in chamber 99 by suitable mounting means along end walls 101, 103 closely adjacent respective web first and second sides 15, 17. The infra-red panels 109 are once again provided to heat web 13 to a temperature of approximately 400° F. completing the curing process.

The last section of the exemplary dryer 10 comprises a cooling zone downstream of the second drying zone. The cooling zone preferably comprises a further chamber 111 within dryer 10 defined by cooling apparatus 113 mounted in dryer 10 by suitable mounting means and sidewalls (not shown). Cooling zone inlet 115 and outlet 117 are provided in chamber 111 for respective entry and exit of web 13 into the cooling zone. The temperature of ambient air in chamber 111 is reduced by cooling apparatus 113 which discharges cooled air through ducts 119–125 into chamber 111 thereby cooling coated web 13 as it moves through chamber 111 in the direction of arrow 93. The cooling zone is provided to reduce the temperature of web 13 and the coating to approximately 125° F. before re-winding of web 13 or before performing further processing of web 13. Forced air, liquid ammonia or other suitable refrigeration systems could be used to cool chamber 111.

FIG. 1 schematically shows exemplary web handling and processing equipment disposed below dryer 10. Web 13 is initially provided in the form of roll 127. Roll 127 is mounted for unwinding on unwinding apparatus 129. Unwinding apparatus 129 includes drive motor 131 connected to shaft 133 on which roll 127 is mounted through appropriate linkage such as gears 137, 139 and endless chain 141 therebetween. Unwinding apparatus may also include a second drive motor 143 connected to drive shaft 145 also by an appropriate linkage such as gears 147, 149 and endless chain 151 therebetween.

Web 13 moves from the unwinding apparatus 129 along idler rollers 153–157, powered rollers 159, 161 to coater 163. Resin or other appropriate coating is applied to web 13 by coater section 165 comprising, for example, a coating bath in which web 13 is immersed. Coated web 13 exits coater 163 by means of powered rollers 167, 169. Web 13 then enters dryer 10 through inlet 53 and is dried as described above.

After exiting dryer 10 through outlet 55, dried web 13 passes over direction-changing rollers 171–183 to rewinding apparatus 185 whereupon the web 13 is wound into a roll 187 of coated web product. Rewinding apparatus 185 includes drive motor 189 connected to shaft 191 on which roll 187 is mounted through appropriate linkage such as gears 193, 195 and chain 197. Rewinding apparatus 185 may also include a second drive motor 199 connected to drive shaft 201 also by an appropriate linkage such as gears 203, 205 and chain 207. The unwinding 129, rewinding 185, coater 163, chill rollers 12, 12*a* and powered rollers are synchronized by appropriate drive and control apparatus (not shown) to move the web 13 at a rate of approximately 40 to 100 feet/minute.

The inventive web processing apparatus 10' will now be described in detail with respect to FIG. 2. The structure and function of many exemplary elements of dryer 10' are identical to the corresponding elements of dryer 10 and share the same reference numbers. The description of such elements (including alternative embodiments) with respect to dryer 10 of FIG. 1 are incorporated herein with respect to dryer 10' of FIG. 2. Dryer 10' will be described with respect to the identical pre-preg coating operation as was described with respect to dryer 10 of FIG. 1. It should be understood that dryer 10' is not limited to use in pre-preg operations.

Dryer 10' includes the same general frame and support structure as dryer 10 including the dryer frame 19, end wall elements 21, 23 and top and bottom walls 25, 27. Sidewalls (not shown) may be provided to fully or partially enclose dryer 10'. Horizontal deck members 29–33, railings 35–39 (shown cut away in FIG. 2), support elements 41–47, vertical supports 49, 51 may be provided. Coating impregnated web 13, having sides 15, 17, enters dryer 10' through upstream inlet 53, travels along web path 57 (in the direction of arrows 59, 91, 93) and is discharged through downstream outlet 55.

Dryer 10' includes a first drying or heating zone which, like dryer 10, includes a chamber 61, opposed end walls 63, 65, opposed sidewalls (not shown), chamber inlet 67, chamber outlet 69 and dryer apparatus (for example, infra-red heating panels 71) provided closely adjacent web path 57 so as to heat and dry coating material on respective web surfaces 15, 17 as web 13 moves through the first drying zone. As with respect to dryer 10, the infra-red panels 71 are provided to heat web 13 to a temperature of approximately 400° F. initiating curing and causing resin solvents to partially evaporate. Again, any suitable drying or heating apparatus may be provided for purposes of drying web 13 within the chamber 61 of the first drying zone.

Chamber 61 of dryer 10' differs from that of dryer 10 in that the chamber 61 is longer and outlet 79 is positioned adjacent air-turn apparatus 11. Chamber 61 advantageously includes a greater number of infra-red panels 71 versus chamber 61 of FIG. 1 thereby permitting more efficient and extended heating and drying of web 13 and web coating than is possible in dryer 10. Such structure increases the rate at which the web can be processed.

Dryer 10' also differs from dryer 10 because it advantageously does not require or include any cooling zone or cooling chamber 73. Dryer 10' advantageously avoids the contamination, cleaning and cost issues described above with respect to dryer 10.

The more efficient design of chamber 61 and capability of operation without a cooling zone or chamber 73 is made possible by the inventive air-turn apparatus 11 and 11*a* which are provided to change the direction of web 13, in this example a total of about 180°. It is unnecessary to cool web 13 before air-turn apparatus 11, 11*a* because such apparatus flotatingly support web 13 thereby avoiding contact between apparatus 11, 11*a* and web 13 and avoiding potential damage to coating on web 13. Further, air-turn apparatus 11 and 11*a* beneficially reduce the axial length, or footprint, of dryer 10' between end walls 21 and 23 by permitting the use of parallel drying sections rather than a single linear dryer section. This advantageous arrangement reduces the amount of space required for dryer 10' in the operator's facility.

The structure of air-turn apparatus 11 will be described in detail below but will be summarized here so as to describe such apparatus with respect to the overall dryer 10'. With respect to FIG. 2, air-turn apparatus 11 and 11*a* are shown in side elevation. Each air-turn apparatus 11, 11*a* preferably has a cylindrically-shaped body 89 rotatably supported with respect to frame 19. Air-turn apparatus 11 flotatingly supports web 13 as the direction of web 13 movement is changed about 90° to the direction of arrow 91. Similarly, air-turn apparatus 11*a* flotatingly supports web 13 as the direction of web 13 movement is changed a further 90° to the direction of arrow 93. A source of pressurized air, such as an air blower 324, provides pressurized air to each air-turn apparatus 11, 11*a*.

As illustrated in FIG. 6A, the pressurized air exits body 89 through body openings 239 to create an air cushion 241 along a web flotation zone 95 formed across a predetermined portion of the outer face, or surface 97 of each air-turn apparatus 11, 11*a*. The air cushion flotatingly supports web 13 across air-turn apparatus 11, 11*a* so that web 13 does not come into physical contact with the air-turn apparatus 11, 11*a*.

It is preferred that each air-turn apparatus 11 and 11*a* is rotatingly driven by a motor 100, gear box 102 and control apparatus 104 (FIG. 3) to synchronize the rotation of the air-turn apparatus 11, 11*a* with the movement of the web 13.

Dryer 10' further includes (a) a second drying section, and (b) a downstream cooling section each of which are identical in structure and function to the corresponding second drying section and downstream cooling section of dryer 10. Second drying section or zone of dryer 10' includes chamber 99, chamber end walls 101, 103, chamber sidewalls (not shown), inlet 105, outlet 107 and infra-red heating panels 109 (or other suitable heating apparatus) provided to maintain the temperature of web 13 at approximately 400° F. completing the curing process. The drying process within the second drying zone of dryer 10' is more efficient than in dryer 10 because such section maintains the web temperature produced by the first drying section and is not required to raise the web temperature from the approximate 125° F. temperature at which the web exits the first cooling chamber of dryer 10.

The cooling section of dryer 10' includes chamber 111 defined by mounted cooling apparatus 113, sidewalls (not shown), inlet 115 and outlet 117. Cooling apparatus 113 and ducts 119–125 introduce cooled air into chamber 111 to cool coated web 13 to a temperature of about 125° F. before re-winding of web 13 or before performing further processing of web 13. Again, forced air, liquid ammonia or other suitable refrigeration systems could be used to cool chamber 111.

The web handling and processing equipment disposed below dryer 10' is identical with respect to structure and function to the web processing equipment shown and described with respect to FIG. 1 and such description is incorporated herein. The unwinding 129, rewinding 185, coater 163, air-turn apparatus 11, 11*a* and rollers described above maintain appropriate tension on web 13 to prevent web 13 from sagging and contacting any stationary surface within dryer 10' and are synchronized by appropriate drive and control apparatus (not shown) to move the web 13 at a rate of approximately 40 to 100 feet/minute.

Before describing the invention in more detail it should be noted that the inventive dryer 10' and air-turn apparatus 11 are not limited to use in pre-preg coating operations. For example, the air-turn apparatus 11 of the invention can be used in other web-processing operations where it is necessary to change the direction of web 13 movement and the coated web side faces the air-turn apparatus. One such example is the lamination operation shown in FIG. 11 and described more fully below. It should also be noted that dryer 10' need not be a vertical-type dryer and could consist of other dryer structure depending on the needs of the operator.

The inventive air-turn apparatus will now be described in greater detail with respect to FIGS. 2–10. Referring first to FIG. 2, that figure shows air-turn apparatus 11 apart from dryer 10' of FIG. 2. While the following description is directed to air-turn apparatus 11, it will be appreciated that such description also applies with respect to air-turn apparatus 11*a* of FIG. 2.

Apparatus 11 includes a body 89 with an outer face, or surface 97. Body 89 is preferably cylindrically-shaped having a center axis 209. In operation, body axis 209 is preferably positioned transverse to the direction of web 13 movement. Body 89 further includes first and second end walls 211 and 213 and central body section 215 therebetween. Central body section 215 includes arcuately-shaped outer surface 97.

Figure 4:
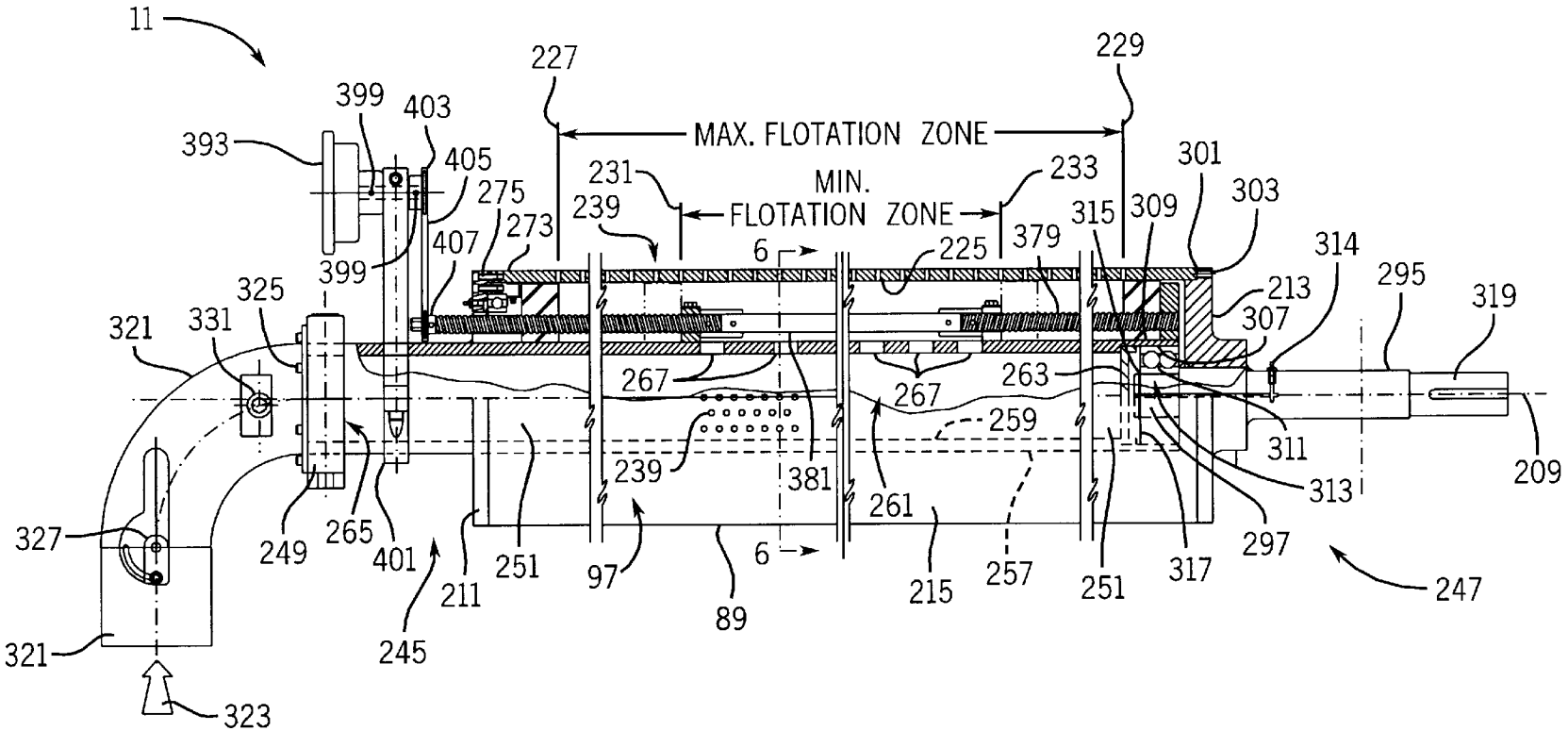
FIG. 4 is a break away view of the air-turn apparatus of FIG. 3. Certain external components of the apparatus are broken away and certain internal components are shown in section along section line 4—4 of FIG. 6.
Figure 5B:
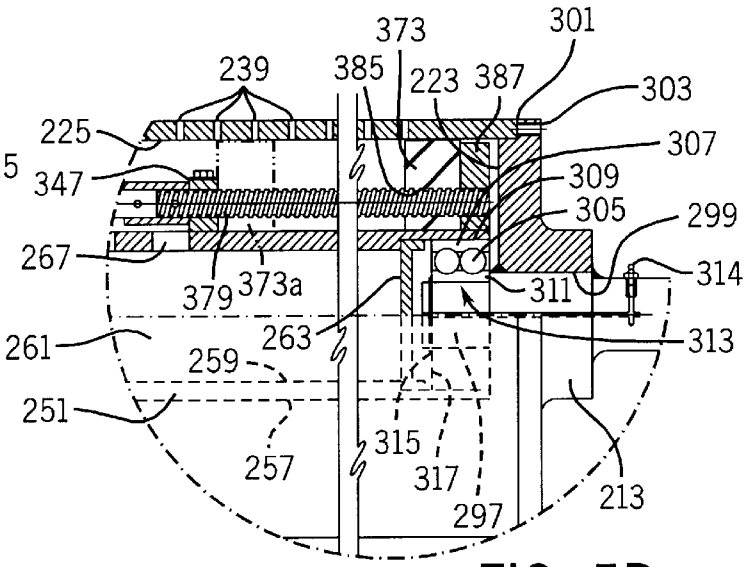
FIG. 5B is the exemplary air-turn apparatus of FIG. 5 including magnified fragmentary views of the apparatus end portion taken along section 5B—5B of FIG. 5.
Figure 5A:
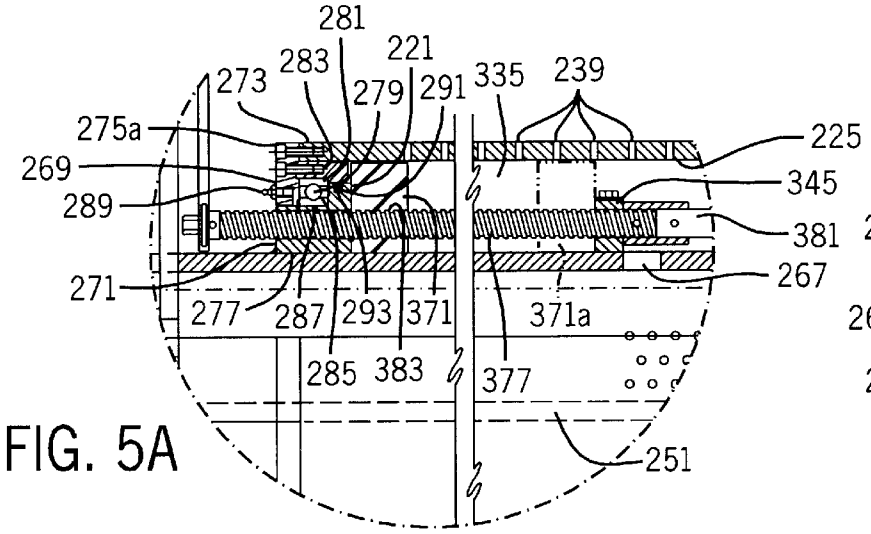
FIG. 5A is the exemplary air-turn apparatus of FIG. 5 including magnified fragmentary views of the apparatus end portion taken along section 5A—5A of FIG. 5.
Figure 5:
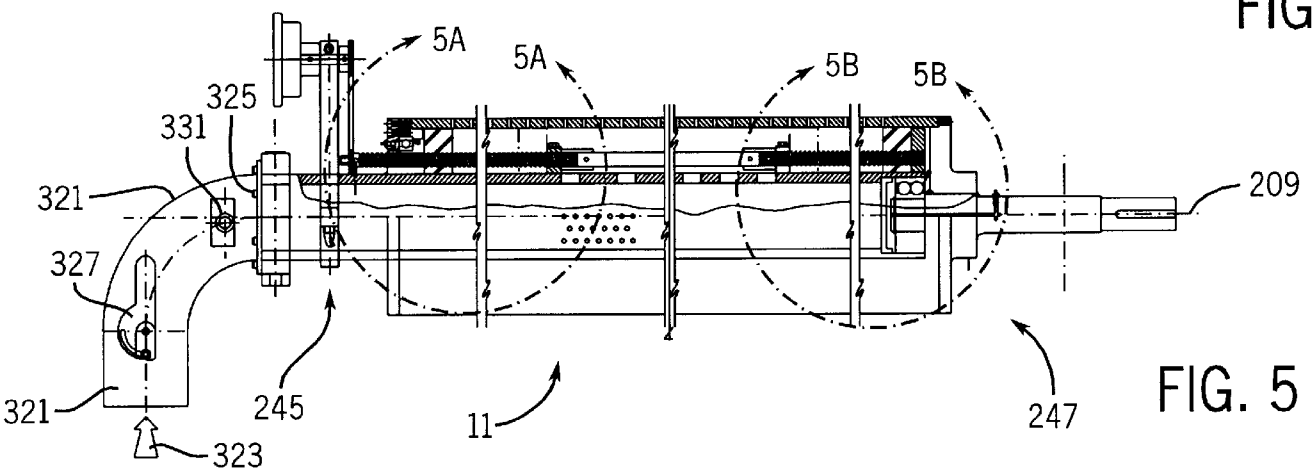
FIG. 5 is the exemplary air-turn apparatus of FIG. 4.

Referring now to FIGS. 4–6, body 89 is preferably hollow and preferably has a generally cylindrically-shaped body inner surface 217 defining hollow body interior 219. Inner surface 217 includes opposed first and second end wall inner surfaces 221 and 223 (FIG. 5) and an arcuately-shaped inner wall central surface 225 therebetween. Body 89 may be made of any suitable material, for example steel or aluminum.

As shown in FIGS. 3–6A, web flotation zone 95 is positioned across a predetermined portion of outer surface 97. In the example shown, web flotation zone 95 has a maximum axial length between reference numbers 227 and 229, a minimum axial length between reference numbers 231 and 233 and an arcuate length between reference numbers 232 and 234 (FIG. 6). The maximum web width suitable for flotation by web flotation zone 95 is between reference numbers 235 and 237. Web flotation zone 95 could have other configurations and orientations depending on the arrangement of body 89.

At least one opening 239 is provided in body 89 between the central body section 215 outer and inner surfaces 97, 225 along web flotation zone 95 although other opening configurations may be suitable. Preferably, the embodiment of FIGS. 2–10 includes plural openings 239. The sectional view provided in FIG. 5 shows that openings 239 are spaced along the circumference of outer surface 97 of body central portion 215. (For convenience only a limited number of openings have been marked with reference number 239) As shown in FIG. 6A, openings 239 provide passageways through which pressurized air, or other suitable gas, is directed through body 89 to provide an air cushion 241 along web flotation zone 95 on which web 13 is flotatingly supported. A release coating 243, such as Teflon®, may be affixed where appropriate to outer surface 97 to minimize any possible adherence of the coating to the body 89 in the unintended event that body 89 should come into contact with web 13.

Figure 7:
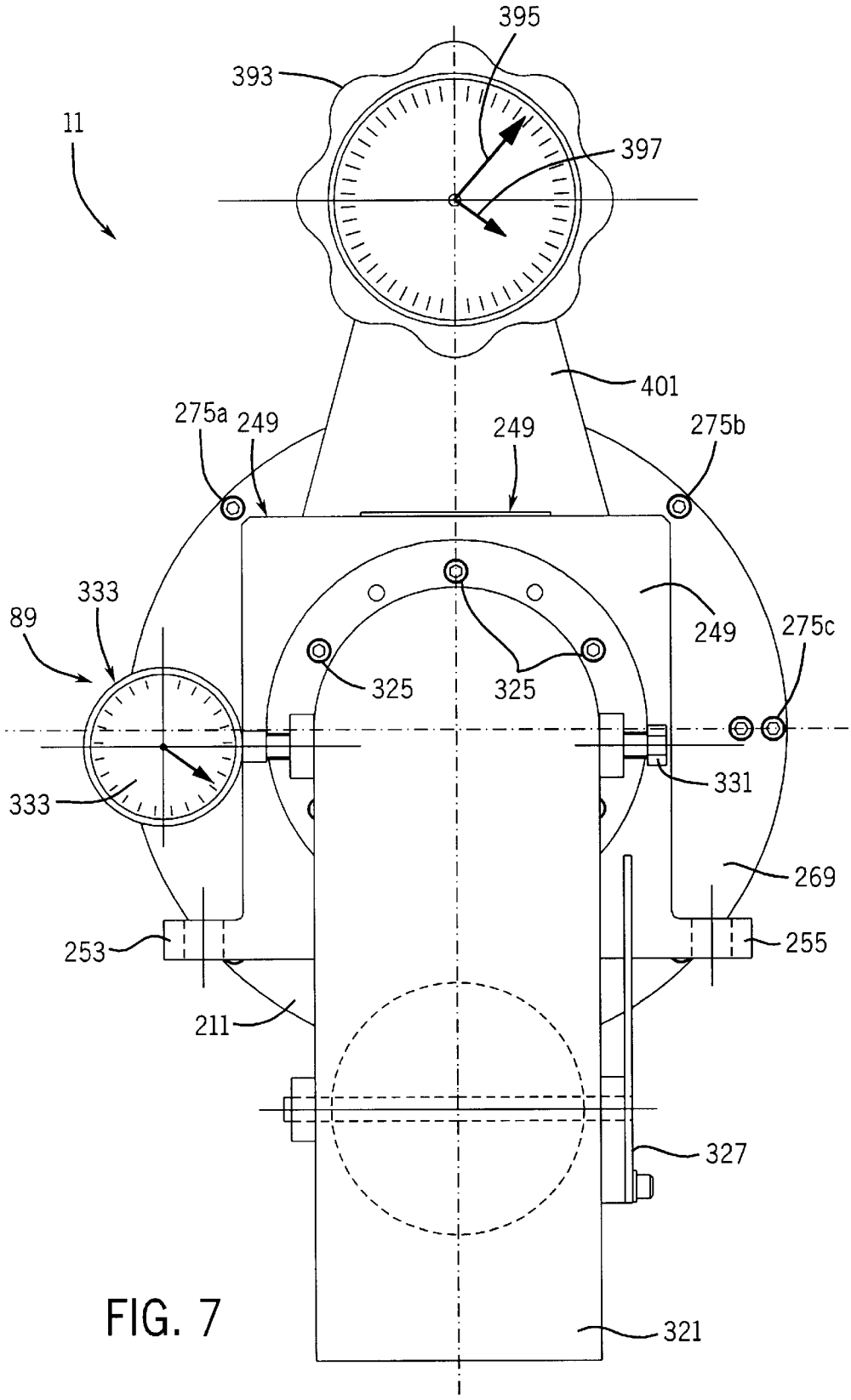
FIG. 7 is an elevation view showing an end view of an exemplary air-turn apparatus including the air supply pipe, mounting block and instruments.

Referring further to FIGS. 3–8, body 89 is supported for rotational movement by first mount 245 along body first end wall 211 and a second mount 247 along body second end wall 213. First mount 245 preferably comprises mounting block 249, centertube 251, first end wall 211 and the related structure as described and shown herein. Mounting block 249 secures body 89 to frame 19 by suitable fasteners at mounting block support arms 253, 255 (FIG. 7). Mounting block support arms 253, 255 may be secured to a corresponding support member (not shown) along frame 19 to support body 89 along body first end wall 211.

The preferred centertube is provided to support body 89 and serve as a conduit to supply pressurized air, or other suitable gas, to body 89 for purposes of forming the air cushion 241 at web flotation zone 95. As best shown in FIGS. 4–6, centertube 251 is preferably a cylindrically-shaped tube with an arcuate outer surface 257, an inner surface 259 defining an air conduit 261, end wall 263 (walls 257–259 are shown partially in phantom lines in FIG. 4) and air inlet 265. As best shown in FIGS. 4 and 6, at least one outlet 267 is provided in centertube 251 to permit air to move through centertube 251, air conduit 261 into body interior 219, through body openings 239 and to web flotation zone 95. Centertube 251 may be made of any suitable material, such as steel.

Centertube 251 is positioned at least partially in body 89 coaxially with axis 209 through first end wall 211. As shown best in FIGS. 4–5, first end wall 211 preferably includes a movable outer end wall section 269 and a concentrically-mounted fixed inner wall section 271. The movable outer end wall section 269 is secured to central body section end wall 273 with suitable fasteners, such as the bolts 275*a–c* shown in FIGS. 5 and 7. Centertube 251 is positioned through an opening 277 in fixed inner end wall 271 and fixed inner end wall section 271 is secured to centertube 251 by appropriate means, such as by welding.

Preferred mount 245 further includes annular single ball bearing row 279 mounted between outer bearing race 281 secured along outer annular shoulder 283 and inner bearing race 285 along inner annular shoulder 287. Grease fitting 289 is provided to permit lubrication of bearings 279. Grease seal 291 is secured in annular groove 293. Second mount 247 preferably comprises shaft 295 which has a first end 297 immovably secured through opening 299 in body second end wall 213 for co-rotation of shaft 295 with body 89. End wall 213 is secured at plural positions to central body section end wall 301 with suitable fasteners, such as the bolt 303 shown in FIG. 4. Shaft 295 is coaxially mounted with body axis 209. Body 89 is further supported for rotational movement by annular double ball bearing row 305 mounted between outer race 307 along centertube annular shoulder 309 and inner race 311 along annular shoulder 313. Grease fitting 314 is provided to permit lubrication of bearings 305. Retaining ring 315 is provided along second shaft 295 to abut wall 317 thereby further limiting movement of body 89 along axis 209. Shaft 295 second end 319 is secured for rotational movement with respect to dryer frame 19 by appropriate means, such as a pillow block bearing (not shown).

Body 89 need not be rotatably mounted and could, instead, be mounted in a stationary manner along dryer frame 19. However, it is most preferred that body 89 is rotatable and synchronized to the rate of web movement because such rotation minimizes any potential adherence of coating on web 13 to the body 89.

Air flow through the air-turn apparatus 11 will now be described particularly with respect to FIGS. 3–7. Pressurized air, or another suitable gas, is driven through supply pipe 321 in the direction of arrow 323 by an air blower 324. Centertube air inlet 265 is secured to supply pipe 321 at mounting block 249 and is joined to supply pipe 321 by suitable fasteners, such as socket head cap screw 325. Air passes from supply pipe 321 and into centertube 251 via inlet 265. The static and volumetric air pressure capacity of the blower will be sufficient to support web 13 and will be selected based on the apparatus 11 structure and requirements of the operator. Suitable pressure blowers are available from The New York Blower Company of Willowbrook, Ill. or Gardner Denver Blower Division/Lamson of Peachtree City, Ga.

Gate valve 327 may be provided to regulate air flow through pipe 321 and into centertube air inlet 265. Threaded opening 329 and mating plug 331 may be provided in pipe 321 for mounting of an air pressure gauge for purposes of monitoring air pressure within supply pipe 321. FIG. 7 shows one such air pressure gauge 333 mounted in an opening (not shown) identical to opening 329.

Body 89, supply pipe 321, centertube 251, mounting block 249 and the associated components may be of any suitable size and configuration required to meet the requirements of a particular application.

As shown in FIGS. 4–6, plural openings 267 are provided in centertube 251 between the centertube outer 257 and inner 259 body surfaces. Centertube openings 267 provide passageways through which pressurized air, or other suitable gas, is directed into preferred plenum 335 within body interior 219, and ultimately through openings 239 about web flotation zone 95. Centertube openings 267 are directionally located in centertube 251 to direct air toward the preferred plenum 335 and to the web flotation zone 95.

Plenum 335 is provided to efficiently direct pressurized air to body openings 239 and to the web flotation zone 95. Plenum 335 is formed between centertube outer surface 257, body inner surface 217 and first and second plenum walls 337, 339 (FIG. 6). Plenum 335, and plenum walls 337, 339 remain stationary as body 89 rotates thereby forming the web flotation zone 95 along body outer surface 97 adjacent plenum 335.

Plenum walls 337, 339 are shown with particularity in FIG. 6 which is a section of FIG. 4 taken along line 6—6. Each plenum wall 337, 339 is welded to centertube 251 along a respective inner end 341, 343 on opposite sides of centertube openings 267 (for example, sides 267*a*, 267*b*). Lead screw supports 345, 347 are secured to a respective wall 337, 339 and centertube 251 by suitable fasteners, such as hex head cap screws 349–353.

Plenum walls 337, 339 each have a first end (not shown) closely abutting first end wall inner surface 221 and a second end (not shown) closely abutting second end wall inner surface 223 in a manner which is sufficiently close to permit rotation of body 89 yet provide a partial air seal between plenum walls 337 and 339 and respective first and second ends 221, 223.

Referring further to FIG. 6, each plenum wall 337, 339 has outer edges closely abutting arcuately-shaped inner wall surface 225. Specifically, seals 355, 357 are secured to a respective plenum wall shoulder 359, 361 by a suitable fastener, such as flat head cap screw 363 and nut 365. Seals 355, 357 extend along the length of walls 337, 339 and are made of a suitable resilient material, such as 0.5 inch thick phenolic laminate. Seal outer faces 367, 369 are contoured to closely correspond to the arc defining body inner surface 225 adjacent each seal outer face 367, 369 forming a partial seal therebetween yet permitting rotation of body 89.

As best shown in FIGS. 4 and 5, deckles 371 and 373 are preferably provided to permit axial adjustment of the plenum 335 and permit the operator to enlarge or reduce the axial length of the web flotation zone 95 between maximum length (between reference numbers 227–229) and minimum length (Between reference numbers 231–233) as needed based on the width of the web 13 being processed.

Deckles 371, 373 are supported for movement along shaft 375 which comprises threaded lead screw 377 (with left-handed threads), threaded lead screw 379 (with right handed threads) and connecting shaft 381. Deckle 371 includes a left-hand-threaded opening 383 and is mounted on lead screw 377 while deckle 373 includes a right-hand-threaded opening 385 and is mounted on corresponding lead screw 379 . Lead screw 377 is journaled in lead screw support 345 and fixed inner end wall 271. Lead screw 379 is journaled in lead screw support 347 and in support member 387 which is welded to centertube 251 outer surface 257.

Preferably, two guide rods may optionally be provided to further support each deckle 371, 373. FIG. 6 shows guide rods 389, 391 provided to support deckle 373. The guide rods supporting deckle 371 are not shown but are of the same structure as guide rods 389, 391. Guide rods 389, 391 are provided with a smooth outer surface and are positioned through corresponding openings (not shown) in deckle 373 so that deckle 373 can slide along the length of guide rods 389, 391 as it is moved axially. Guide rods 389, 391 are each mounted along a separate axis (not shown) parallel to shaft 375 and each have outer ends (not shown) which are inserted into corresponding openings (not shown) in support member 387 and an inner end inserted into lead screw support 347 as shown in FIG. 6. Similarly, the unshown guide rods supporting deckle 371 each have an outer end which is inserted into a corresponding opening in fixed inner end wall 271 and a second end inserted into a corresponding opening in lead screw support 345.

Each deckle 371, 373 is preferably made of a phenolic material and is sized and shaped to form an adjustable seal in the plenum 335 between body central portion inner surface 225, centertube outer wall surface 257 and plenum walls 337, 339. Deckles 371, 373, therefore, act as axially-adjustable seals directing airflow from plenum 335 and through openings 239.

The axial position of deckles 371, 373 (and, accordingly the axial length of plenum 335 and web flotation zone 95) are adjusted by rotating shaft 375 causing the action of respective lead screws 377, 379 to move deckles 371, 373 toward or away from the other depending on the direction of rotation of shaft 375. In FIG. 5, deckles 371 and 373 in solid line show the deckle position providing the maximum flotation zone axial length while the deckles 371*a*, 373*a* in phantom line show the deckle position for the minimum flotation zone axial length.

Referring further to FIGS. 3–7, shaft 375 is rotated by manually rotating web flotation length indicator 393 in a clockwise or counterclockwise direction. Indicator 393 includes indicator arms 395, 397 showing the position of deckles 371, 373. Indicator 393 is mounted on shaft 399 journaled on support arm 401 and connected to gauge sprocket 403. Sprocket 403 is linked to shaft 375 via chain 405 which engages shaft sprocket 407 mounted along shaft 375.

Figure 3:
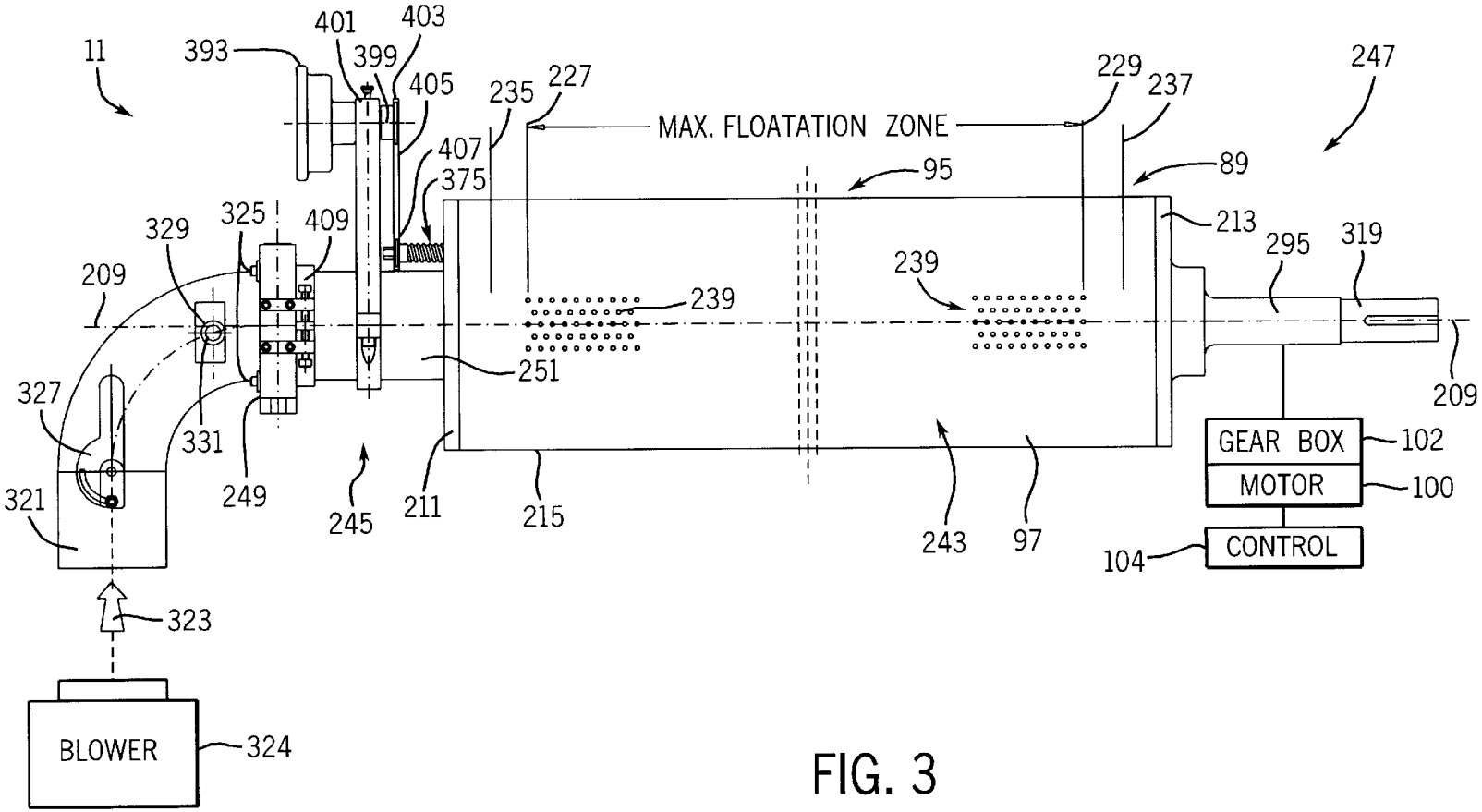
FIG. 3 is a plan view of an exemplary air-turn apparatus according to the invention.

As shown in FIG. 3, a flotation zone fine orientation adjustment 409 may be provided to permit rotation of centertube 251 so that centertube openings 267 are optimally directed toward plenum 335. Adjustment 409 is essentially a clamping device which may be loosened to permit rotation of centertube 251 with respect to mounting block 249 thereby permitting the operator to adjust the position of web flotation zone 95.

As in FIG. 3, body 89 may be rotatably driven by a motor 100 through an appropriate gear box 102, for example along second shaft 295. Control apparatus 104 may be provided to control the motor. The motor driven rotation of the body 89 synchronizes body 89 rotation to the rate of web 13 movement. Motor driven synchronization of body 89 with web 13 advantageously limits potential frictional contact between air-turn apparatus 11 and coated web 13 in the event that the 13 were to contact body outer surface 97.

Figure 8:
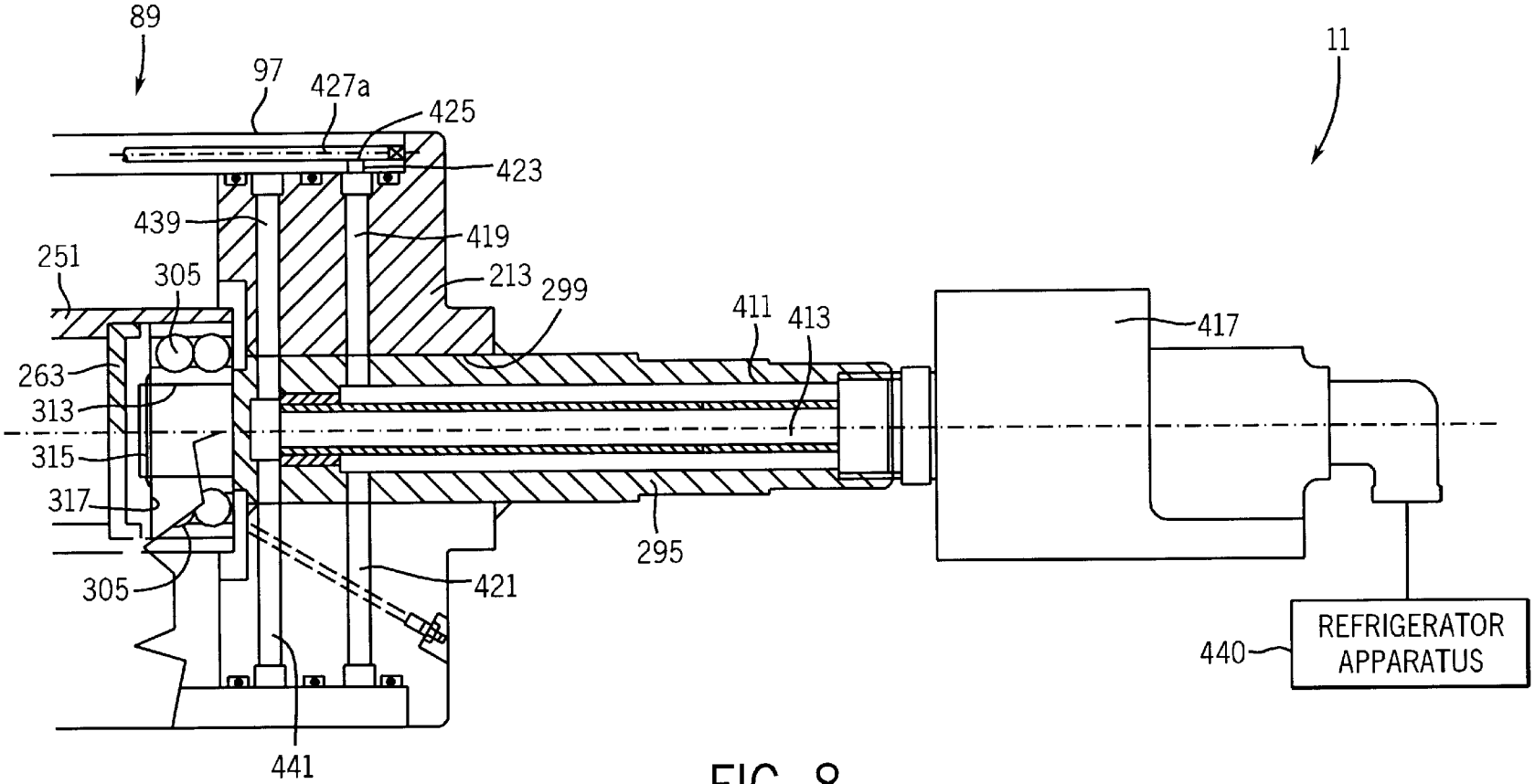
FIG. 8 is an enlarged partial section and break away view of an exemplary air-turn apparatus taken along section 8—8 of FIG. 6 showing the coolant supply and return conduits.
Figure 9:
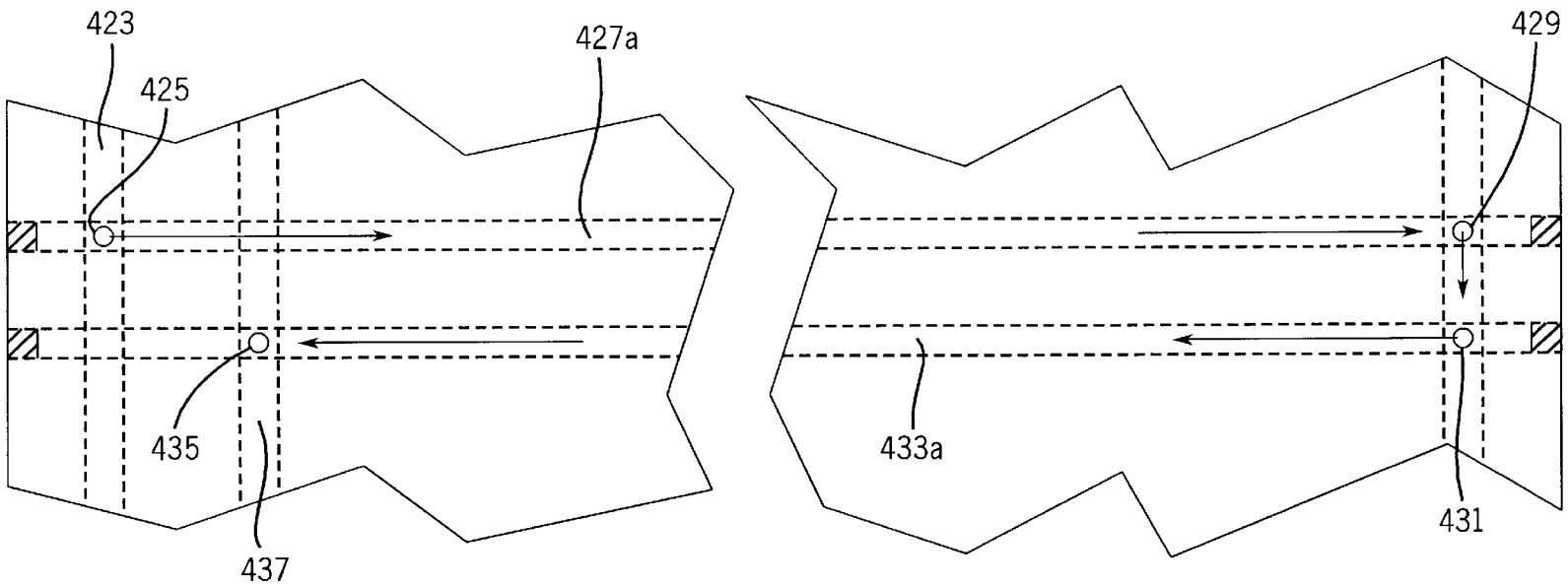
FIG. 9 is a schematic diagram and cut away view showing exemplary coolant-conducting conduits taken along an air-turn apparatus body section.
Figure 10:
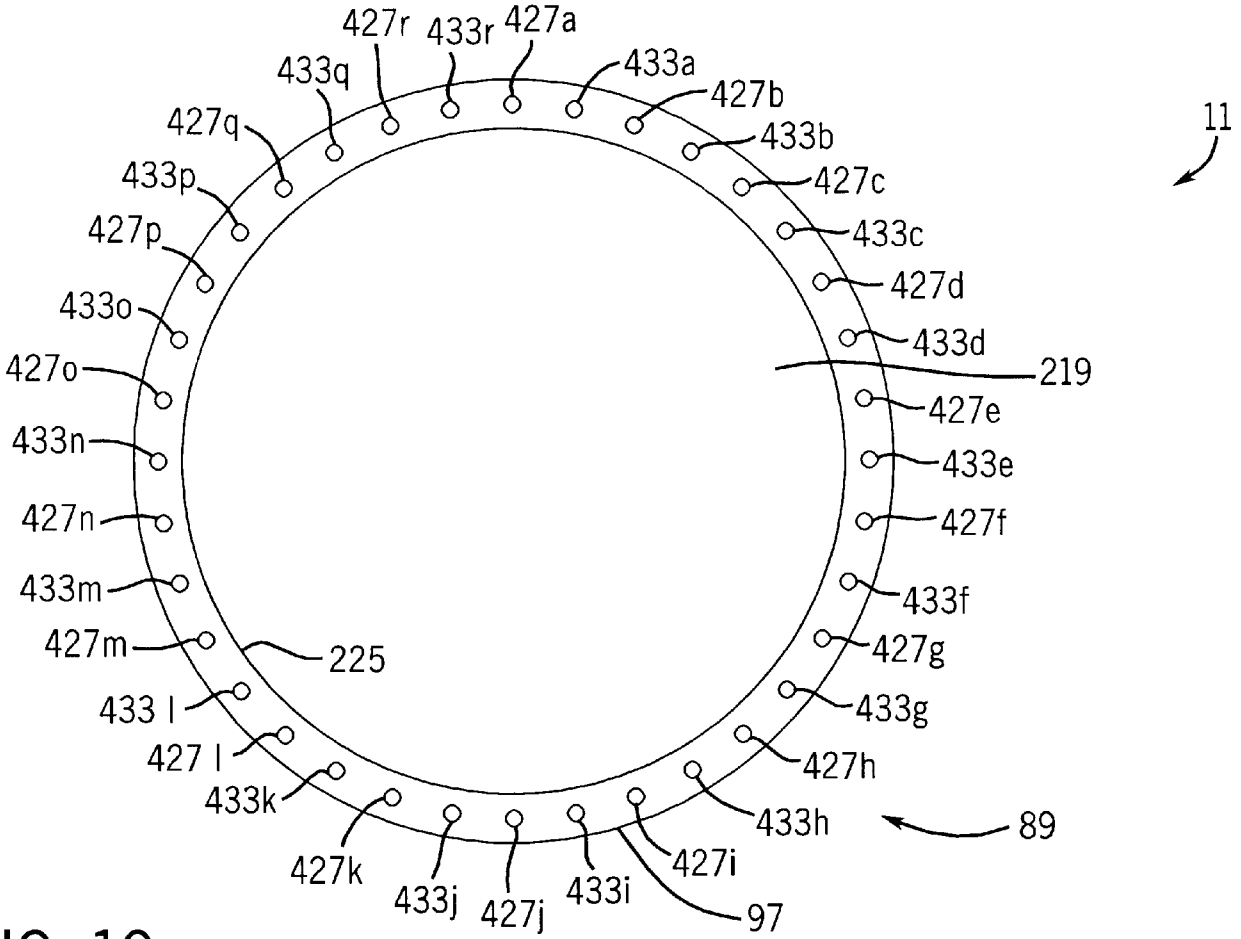
FIG. 10 is a schematic diagram of exemplary coolant-conducting conduits provided in an embodiment of the air-turn apparatus body.

Referring next to FIGS. 8–10, body 89 may be chilled to limit any possible sticking of heated coating materials to body outer surface 97 in the unintended event that web 13 should contact body 89. Preferably, the chilling system comprises coolant supply and return conduits positioned in body 89 between body outer 97 and inner 225 surfaces and suitable coolant refrigeration apparatus 440 in fluid communication therewith.

FIGS. 8–10 illustrate a preferred chilling system for use in connection with the invention. Coaxial coolant supply 411 and return 413 conduits are provided in second shaft 295. Supply 411 and return 413 conduits are in fluid communication with a rotary union 417. The rotary union will be selected based on the apparatus 11 structure and requirements of the operator. Suitable rotary unions are available from the Deublin Company of Waukegan, Ill. At an opposite end, supply 411 and 413 conduits are in fluid communication with respective end wall supply conduits 419, 421. Conduits 419, 421 are cross drilled in second end wall 213 and extend radially outwardly and in fluid communication with an annular supply conduit 423 provided around second end wall 213.

Annular supply conduit 423 is in fluid communication with an inlet end (such as end 425 in FIG. 9) of alternating supply conduits 427*a*–*r* provided in body 89. Supply conduits 427*a*–*r* each have a outlet end along first end wall 211 (such as end 429 in FIG. 9) in fluid communication with a respective inlet end (such as end 431 in FIG. 9) of alternating return conduits 433*a*–*r*. Supply 427*a*–*r* and return 433*a*–*r* conduits may be gun drilled in body 89. Return conduits 433*a*–*r* each have a respective return outlet end along second end wall 213 (such as end 435 in FIG. 9) in fluid connection with annular return conduit 437 (FIG. 9) provided in second end wall 213. Annular return conduit 437 is in fluid communication with end wall return conduits 439, 441 which are cross drilled in second end wall 213 and extend radially inwardly to coolant return conduit 413. Return coolant from conduit 413 flows to rotary union 417 to complete the fluid pathway through body 89.

Suitable refrigeration apparatus 440 is provided to supply pressurized coolant (not shown) to body 89 via the fluid pathway formed by rotary union 417, supply conduits 411, 419, 421, 427*a*–*r* conduits and return conduits 433*a*–*r*, 437, 439, 441 and 413. Any suitable coolant is satisfactory for use in the invention including, for example, chilled water, ammonia or polyethylene glycol.

Figure 11:
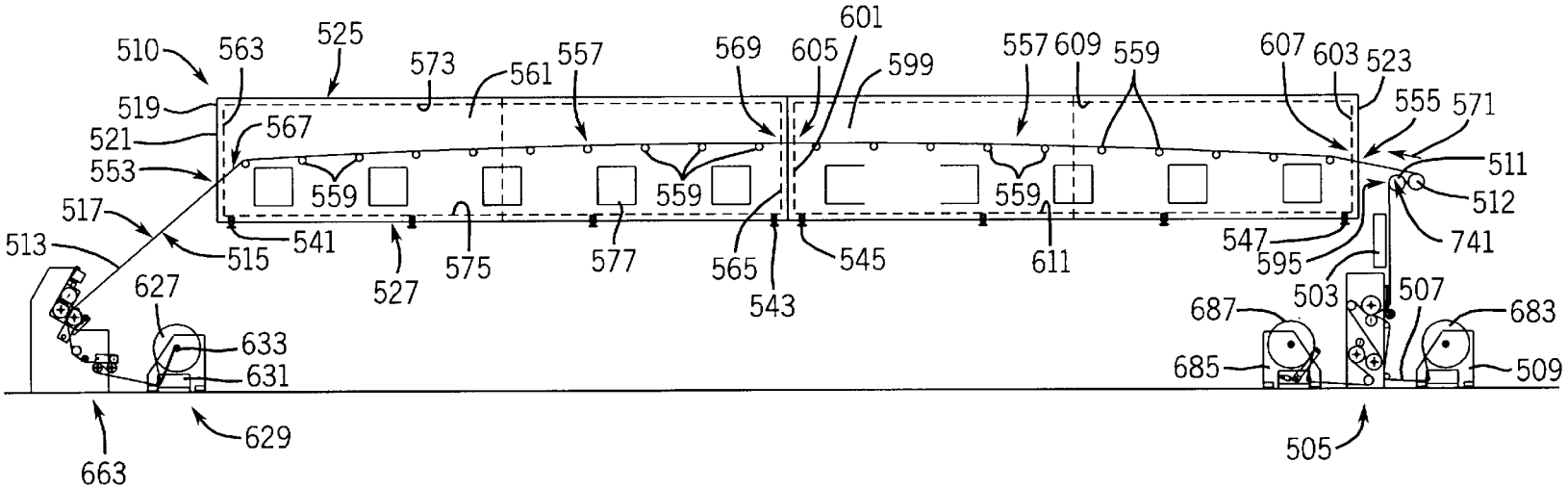
FIG. 11 is an elevation view of an improved lamination operation including an exemplary air-turn apparatus according to the invention.

The exemplary embodiment shown in FIG. 11 is provided to demonstrate that the inventive air-turn apparatus may be used in connection with web-processing operations other than the exemplary pre-preg coating operation illustrated in FIG. 2. FIG. 11 schematically illustrates a laminating operation in which a laminate film is applied to an adhesive-containing release paper backing. Adhesive applied to the release paper backing transfers onto the laminate film permitting the laminate film to be removed from the release paper backing and applied to an appropriate surface. The laminate film may include graphic information and artwork and may be die cut for making, for example, package labels.

Referring now to FIG. 11, release paper web 513 is initially provided in the form of roll 627. (The last two digits of the apparatus of FIG. 11 are selected to correspond with the last two digits of the apparatus of FIGS. 2–10.) Roll 627 is mounted for unwinding on unwinding apparatus 629. Unwinding apparatus 629 includes drive motor 631 connected to shaft 633 on which roll 627 is mounted through appropriate linkage (not shown).

Web 513 moves from unwinding apparatus 629 to coater 663. Coater 663 applies suitable adhesive (not shown) solely to web side 517 which is the web side opposite chill roller 512. Chill roller 512 cannot be used to contact or support a coated side 517 of web 513 because adhesive would adhere to chill roller 512 potentially damaging the coating and contaminating chill roller 512.

After coating, web 513 travels (in a clockwise direction according to FIG. 11) to dryer 510 for drying. Web 513 enters dryer 510 through web inlet 553, travels along web path 557, supported by dryer rollers 559 (for convenience only a limited number of rollers 559 are marked) and exits dryer 510 through web outlet 555.

Dryer 510 includes dryer frame 519 opposed end walls 521, 523, and top and bottom walls 525, 527. Dryer support elements 541–547 support dryer 510 along an appropriate support surface (not shown).

Dryer 510 is divided into any number of appropriate drying or heating zones provided along web path 557 for purposes of drying the adhesive coating applied to web 513 by coater 663. Dryer 510 includes first and second drying or heating zones each including a respective chamber 561, 599. As shown by the phantom lines, each chamber 561, 599 is defined by respective end walls 563, 565 and 601, 603 and by respective top and bottom walls 573, 575 and 609, 611. Web 513 enters drying zone chamber 561 through inlet 567 and enters drying zone chamber 599 through inlet 605. Heater apparatus (not shown) is provided to circulate heated ambient air into a respective drying zone chamber 561 or 599 to heat web 513 therein to a temperature of between about 120–450° F. (or greater) thereby curing the adhesive. Access panels, such as panel 577, may be provided to access internal portions of dryer 510.

An important consequence of the adhesive drying process is that web 513 comprising the release paper backing tends to curl or wrinkle as a result of moisture loss during drying. Steam moisturizer 503 is provided downstream of dryer 510 and closely proximate to web 513 to impregnate web 513 with moisture-containing steam thereby removing the curling and causing the web to relax before the lamination step.

After exiting dryer 510 and before reaching steam moisturizer 503, web 513 passes over driven refrigerated chill roller 512 which is rotated synchronously with web 513. Chill roller 512 causes the direction of web movement to change to the direction of arrow 571. Rotating chill roller 512 is provided to decrease the temperature of web 513 so that the web will accept moisture from the steam moisturizer 503.

Air-turn apparatus 511 of the invention is next provided to change the direction of web movement approximately 130° from the direction of arrow 571. Air-turn apparatus 511 is driven to rotate synchronously with web 513. Air-turn apparatus 511 has the same structure and pressurized air source as apparatus 11 of FIGS. 2–10 described above and such description is incorporated herein by reference. Air-turn apparatus 511 may also be chilled as described above with respect to apparatus 11.

Air-turn apparatus 511 is able to accomplish the advantageous direction-changing result because, unlike chill roller 512, air-turn apparatus 511 may be positioned facing coated web side 517. Air-turn apparatus 511 can face coated web side 517 because web 513 is flotatingly supported on air cushion 741 along web flotation zone 595 and coated web side 517 does not come into physical contact with air-turn apparatus 511. This direction-changing result is not possible using only chill roller 512 because chill roller 512 directly contacts and supports web 513 and would cause adhesive on coated side 517 to adhere to the roller 512, possibly damaging the adhesive coating. Web direction, using only chill roller 512, can be changed at most about 180° thereby limiting the configuration of the components forming the laminating operation in a way which may potentially be unacceptable for certain operators.

Use of inventive air-turn apparatus 511 provides the operator with significant flexibility to meet the space constraint needs of the operator by allowing the manufacturer to direct the web 513 in any suitable direction. For example, plural air-turn apparatus 511 could be used to direct web 513 along a back-and-forth web path 557 to various dryers and treating apparatus as needed. Because air-turn apparatus 511 does not contact web 513, it is not necessary to provide a separate web-cooling chamber (such as chamber 73 in FIG. 1) upstream of apparatus 511. Chill roller 512 sufficiently cools web 513 so that web 513 can be further processed by the laminator 505 described below. Avoidance of the cooling chamber represents a significant cost saving to the operator.

From the steam moisturizer 503, web 513 next enters laminator 505. Laminator 505 applies laminate film 507 supplied from roll 683 by laminate unwinding device 509 to the web 513 along web surface 517. The web 513, including the laminate film 507, exits laminator 505 and travels to rewinding apparatus 685 whereupon the web 513 is formed into a roll 687 of laminate product.

The dryer and air-turn apparatus of the invention advantageously facilitate an improvement in the quality of products manufactured in coating and web-processing operations because the air-turn apparatus flotatingly supports the web and does not physically contact the web or web coating thereby avoiding damage to the coating and preventing coating from adhering to the air-turn apparatus.

Use of processing equipment, such as dryer 10' including the air-turn apparatus of the invention, permits more efficient and compact design of the dryer and other processing operations making it easier to tailor and size the configuration of the dryer and coating equipment to the requirements of the operator.

Moreover, by eliminating any requirement for the first cooling chamber 73 and cooling apparatus 75 it is possible to avoid contamination of the web and web coating by flaking of condensates and other contaminates off of the cooling apparatus 75 and onto the web. Elimination of the first cooling chamber also reduces maintenance costs for cleaning of the dryer and limits dryer down time for cleaning and maintenance. Elimination of the cooling apparatus may also reduce the cost to manufacture the dryer.

Elimination of any requirement for the first cooling chamber and cooling apparatus is further advantageous because less energy is required to operate the dryer both with respect to the energy needed to cool the web and energy needed to reheat the web following cooling. By eliminating the need to cycle the web temperature it is possible to process the web more quickly and efficiently.

It should be understood that considerable variation in the exemplary components described herein may be provided within the scope of the invention. For example, body 89 need not be completely hollow as forms of conduits other than centertube 251 may be used to direct pressurized air to the web flotation zone 95. Body 89 could consist of plural body portions and have alternative configurations provided that such body apparatus produced the desired web flotation zone 95. Alternative mount structure 245, 247 could be provided to support body 89 with respect to dryer 10' and to permit rotation of the body 89. For example, first bearing row 279 need not be positioned between the first end wall sections 269, 271. Shaft 295 could be mounted for rotation with respect to second end wall 213. Alternative forms of cooling apparatus could be used in connection with the air-turn apparatus 11.

While the principles of this invention have been described in connection with specific embodiments, it should be understood clearly that these descriptions are made only by way of example and are not intended to limit the scope of the invention.

What is claimed is:

1. In a dryer for drying a coated web moving therethrough, said dryer having a frame with a web inlet, a web outlet and a web path therebetween, dryer apparatus mounted with respect to the frame along the web path, at least one web-turning apparatus mounted with respect to the frame for changing the direction of web movement, the improvement wherein the at least one web-turning apparatus is an air-turn apparatus comprising:

a body having an arcuate outer surface defining an arcuate web flotation zone facing a coated side of the web and a plurality of openings in the body positioned along the web flotation zone through which pressurized air from an air blower is directed to form an air cushion along the web flotation zone, said air cushion being of sufficient volume to support the moving web fully spaced apart from the body, said body being rotatably mounted with respect to the frame for rotational movement in the direction of web movement;

an air-conducting conduit at least partially in the body, the conduit having an inlet for receiving pressurized air and at least one outlet in communication with the body openings thereby providing a passageway through which the pressurized air is directed out of the body to form the air cushion along the web flotation zone;

the air blower being in communication with the conduit inlet, said air blower providing the pressurized air to the conduit in the volume sufficient to generate the air cushion along the web flotation zone fully supporting the coated web; and drive apparatus in power-transmission relationship with the body to rotate the body synchronously with the web in the direction of web movement;

whereby the coated web is fully supported for direction change within the dryer by the air cushion along the web flotation zone of the at least one rotating air-turn apparatus so that the coated side of the web does not continuously contact the air-turn apparatus.

2. The dryer of claim 1 wherein the air-turn apparatus body is cylindrically-shaped and has a body axis, first and second end walls, the arcuate outer surface is between the end walls and the web flotation zone is positioned across a predetermined portion of the arcuate outer surface.

3. The dryer of claim 2 wherein:

the air-turn apparatus body has an inner wall surface defining a body interior; and the body openings are in communication with the body interior.

4. The dryer of claim 3 wherein the air-turn apparatus body further includes a first mount along the body first end wall and a second mount along the body second end wall, the mounts provided for rotatably supporting the body with respect to the frame.

5. The dryer of claim 4 wherein:

the air-conducting conduit is a stationary centertube;

the first mount comprises:

the first end wall, said end wall including (a) a fixed inner end-wall having an opening coaxial with the body axis for receiving the centertube and (b) a rotatable outer end-wall secured to the body and mounted for rotation with respect to the fixed inner end-wall; and the stationary centertube, said centertube being secured with respect to the frame and positioned within the fixed inner end-wall opening to support the first end wall, the centertube defining a hollow air conduit with at least one air outlet in communication with the body openings; and the second mount comprises a shaft supporting the air-turn apparatus body along the body axis, the shaft having a first end secured with respect to the second end wall for co-rotation of the shaft with the body and a second end portion rotatably secured with respect to the frame.

6. The dryer of claim 5 wherein the air-turn apparatus further includes walls forming a plenum between the centertube and the body inner wall surface adjacent the web flotation zone for directing pressurized air from the centertube to the web flotation zone.

7. The dryer of claim 6 wherein the air-turn apparatus further includes:

at least one movably-mounted deckle in the plenum, the at least one deckle being sized and shaped to closely abut the centertube, plenum walls and body inner wall surface adjacent the web flotation zone thereby forming at least one axially-adjustable seal directing pressurized air to a predetermined portion of the web flotation zone; and deckle-movement apparatus for axial displacement of the at least one deckle.

8. The dryer of claim 4 wherein the air-turn apparatus further includes a coolant-conducting conduit in the air-turn apparatus body, the conduit being in heat-transfer communication with the body outer surface and having an inlet for receiving pressurized coolant and an outlet for discharging the coolant.

9. The dryer of claim 8 wherein at least a portion of the coolant-conducting conduit is positioned between the body inner and outer wall surfaces.

10. The dryer of claim 9 wherein the coolant inlet and outlet comprise separate passageways in the second mount.

11. The dryer of claim 8 further including refrigeration apparatus in fluid communication with the conduit inlet and outlet for supplying chilled coolant to the conduit.

12. The dryer of claim 1 wherein the drive apparatus includes:

a motor;

linkage apparatus connecting the motor to the air-turn apparatus body; and control apparatus for controlling the motor.

13. The dryer of claim 1 further comprising a release coating affixed to the air-turn apparatus arcuate outer surface.

14. A rotatable air-turn apparatus for flotatingly supporting a moving web having a coated side facing the air-turn apparatus comprising:

a cylindrically-shaped body having first and second end walls, a body center axis, an arcuate outer surface defining an arcuate web flotation zone facing the coated side of the web and a plurality of openings in the body positioned along the web flotation zone through which pressurized air from a pressurized air source is directed to form an air cushion along the web flotation zone, said air cushion being of sufficient volume to flotatingly support the moving web fully spaced apart from the body;

an air-conducting conduit at least partially in the body, the conduit having an inlet for receiving pressurized air from the pressurized air source and at least one outlet in communication with the body openings thereby providing a passageway through which the pressurized air is directed out of the body to form the air cushion along the web flotation zone; and a first mount along the body first end wall and a second mount along the body second end wall, said mounts adapted to rotatably support the body about the center axis for rotation in the direction of web movement;

whereby the web is supported by the air cushion along the web flotation zone so that the coated side of the web does not continuously contact the air-turn apparatus.

15. The apparatus of claim 14 wherein:

the body has an inner wall surface defining a body interior; and the body openings are in communication with the body interior.

16. The apparatus of claim 14 wherein:

the air-conducting conduit is a stationary centertube;

the first mount comprises:

the first end wall, said end wall including (a) a fixed inner end-wall having an opening coaxial with the body axis for receiving the centertube and (b) a rotatable outer end-wall secured to the body and mounted for rotation with respect to the fixed inner end-wall; and the stationary centertube, said centertube being positioned within the fixed inner end-wall opening to support the first end wall, the centertube defining a hollow air conduit with at least one air outlet in communication with the body openings; and the second mount comprises a shaft supporting the air-turn apparatus body along the body axis, the shaft having a first end secured with respect to the second end wall for co-rotation of the shaft with the body and a second end portion.

17. The apparatus of claim 16 wherein the air-turn apparatus further includes walls forming a plenum between the centertube and the body inner wall surface adjacent the web flotation zone for directing pressurized air from the centertube to the web flotation zone.

18. The apparatus of claim 17 wherein the air-turn apparatus further includes:

at least one movably-mounted deckle in the plenum, the at least one deckle being sized and shaped to closely abut the centertube, plenum walls and body inner wall surface adjacent the web flotation zone thereby forming at least one axially-adjustable seal directing pressurized air to a predetermined portion of the web flotation zone;and deckle-movement apparatus for axial displacement of the at least one deckle.

19. The apparatus of claim 14 wherein the air-turn apparatus further includes a coolant-conducting conduit in the air-turn apparatus body, the conduit being in heat-transfer communication with the body arcuate outer surface and having an inlet for receiving pressurized coolant and an outlet for discharging the coolant.

20. The apparatus of claim 19 wherein the air-turn apparatus body has an inner surface spaced apart from the arcuate outer surface and at least a portion of the coolant-conducting conduit is positioned between the body inner and outer surfaces.

21. The apparatus of claim 20 wherein the coolant inlet and outlet comprise separate passageways in the second mount.

22. The apparatus of claim 14 further comprising a release coating affixed to the arcuate outer surface.

* * * * *